US008850857B2

(12) United States Patent
Valade, Jr. et al.

(10) Patent No.: US 8,850,857 B2
(45) Date of Patent: Oct. 7, 2014

(54) DETACHER FOR A SECURITY DEVICE

(75) Inventors: Franklin H. Valade, Jr., Fort Walton Beach, FL (US); Thomas G. Riley, Mint Hill, NC (US); Firas H. Faham, Boynton Beach, FL (US); Gilbert Fernandez, Weston, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 11/920,968

(22) PCT Filed: May 23, 2006

(86) PCT No.: PCT/US2006/020293

§ 371 (c)(1),
(2), (4) Date: Feb. 2, 2009

(87) PCT Pub. No.: WO2006/127925

PCT Pub. Date: Nov. 30, 2006

(65) Prior Publication Data

US 2009/0229327 A1 Sep. 17, 2009

Related U.S. Application Data

(60) Provisional application No. 60/683,657, filed on May 23, 2005.

(51) Int. Cl.
*E05B 65/00* (2006.01)
*E05B 73/00* (2006.01)

(52) U.S. Cl.
CPC ..... *E05B 73/0052* (2013.01); *E05B 73/0005* (2013.01); *E05B 73/0017* (2013.01)
USPC ..... 70/57.1; 70/276; 206/1.5; 206/308.1; 206/387.11; 340/572.9

(58) Field of Classification Search
USPC ..... 70/57.1, 58, 276, 413; 206/1.5, 387.11, 206/308.1, 308.2; 340/572.9, 568.1; 292/251.5
See application file for complete search history.

(56) References Cited

U.S. PATENT DOCUMENTS

| | | | | |
|---|---|---|---|---|
| 5,528,914 | A * | 6/1996 | Nguyen et al. | 70/57.1 |
| 5,942,978 | A * | 8/1999 | Shafer | 340/572.9 |
| 5,955,951 | A * | 9/1999 | Wischerop et al. | 340/572.8 |
| 7,242,304 | B2 * | 7/2007 | Clancy et al. | 340/572.9 |
| 8,378,826 | B2 * | 2/2013 | Mercier et al. | 340/572.1 |
| 2009/0229327 | A1 * | 9/2009 | Valade et al. | 70/277 |

* cited by examiner

*Primary Examiner* — Suzanne Barrett

(57) ABSTRACT

Systems, methods, and apparatuses for a detacher for a security device are disclosed. The detacher (180*c*) includes a magnet (1820) that can be moved relative to a housing (1810) by a motor (1830). Magnet and motor are mounted inside the housing.

17 Claims, 21 Drawing Sheets

DETAIL A

DETACHER FOR A SECURITY DEVICE

This application claims priority to the U.S. Provisional Patent Application Ser. No. 60/683,657 titled "Improved EAS Security Tags" filed May 23, 2005, which is incorporated herein by reference in its entirety.

BACKGROUND

A security tag system is designed to prevent unauthorized removal of an item from a controlled area. For example, a typical Electronic Article Surveillance (EAS) system may comprise a monitoring system and one or more security tags. The monitoring system may create a surveillance zone at an access point for the controlled area. A security tag may be enclosed in a security device that is secured to the monitored item, such as an article of hard goods, e.g., sporting equipment, eye wear, jewelry, bottles, and the like. If the monitored item enters the surveillance zone, an alarm may be triggered to indicate unauthorized removal.

When the monitored item is sold, a cashier may remove the security device using a detacher.

It may be desirable to have a detacher and associated system that make such removal more difficult where not authorized, such as for an unsold item. Consequently, there may be a need for improved techniques in security devices and detachers in general, and systems for securing and detaching the security devices in particular.

BRIEF DESCRIPTION OF THE DRAWINGS

The subject matter regarded as embodiments is particularly pointed out and distinctly claimed in the concluding portion of the specification. Embodiments, however, both as to organization and method of operation, may best be understood by reference to the following detailed description when read with the accompanying drawings in which:

DETAILED DESCRIPTION

Embodiments may be directed to apparatuses, systems and methods for selectively detaching security devices from articles when authorized.

The security devices may include a security tag and may thus pair an article, such as a compact disc (CD), sporting equipment, eye wear, jewelry, bottles, and the like, with a security tag. For example, one embodiment may include a security device comprising a locking mechanism, security tag, and a housing. The locking mechanism may comprise a magnetically actuable latch, a flexible element that biases the magnetically actuable latch toward a locking position, and a latch mating element that mates with at least a portion of the magnetically actuable latch in the locking position. As used herein, the "locking position" may refer to the position of the magnetically actuable latch in which it is partially or fully within a void of, in engagement with, joined with, or otherwise mated with the latch mating element. The housing may be a structure configured to partially or fully contain, enclose, or otherwise secure the locking mechanism, security tag, latch mating element, and the article to the housing. As secured, the magnetically actuable latch of the locking mechanism may mate with the latch mating element in the locking position to lock the housing, and thus the security tag with which the housing is secured, to the article. When the housing is locked, the security device may prevent or provide resistance to an attempt to separate the housing from the article. Another embodiment may include a security system comprising the security device and a detacher, which may be a device that includes a magnet. The detacher may be employed to unlock the housing by magnetically forcing the magnetically actuable latch away from the locking position.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures and components have not been described in detail so as not to obscure the embodiments. It can be appreciated that the specific structural and functional details disclosed herein may be representative and do not necessarily limit the scope of the embodiments.

Figure 1:
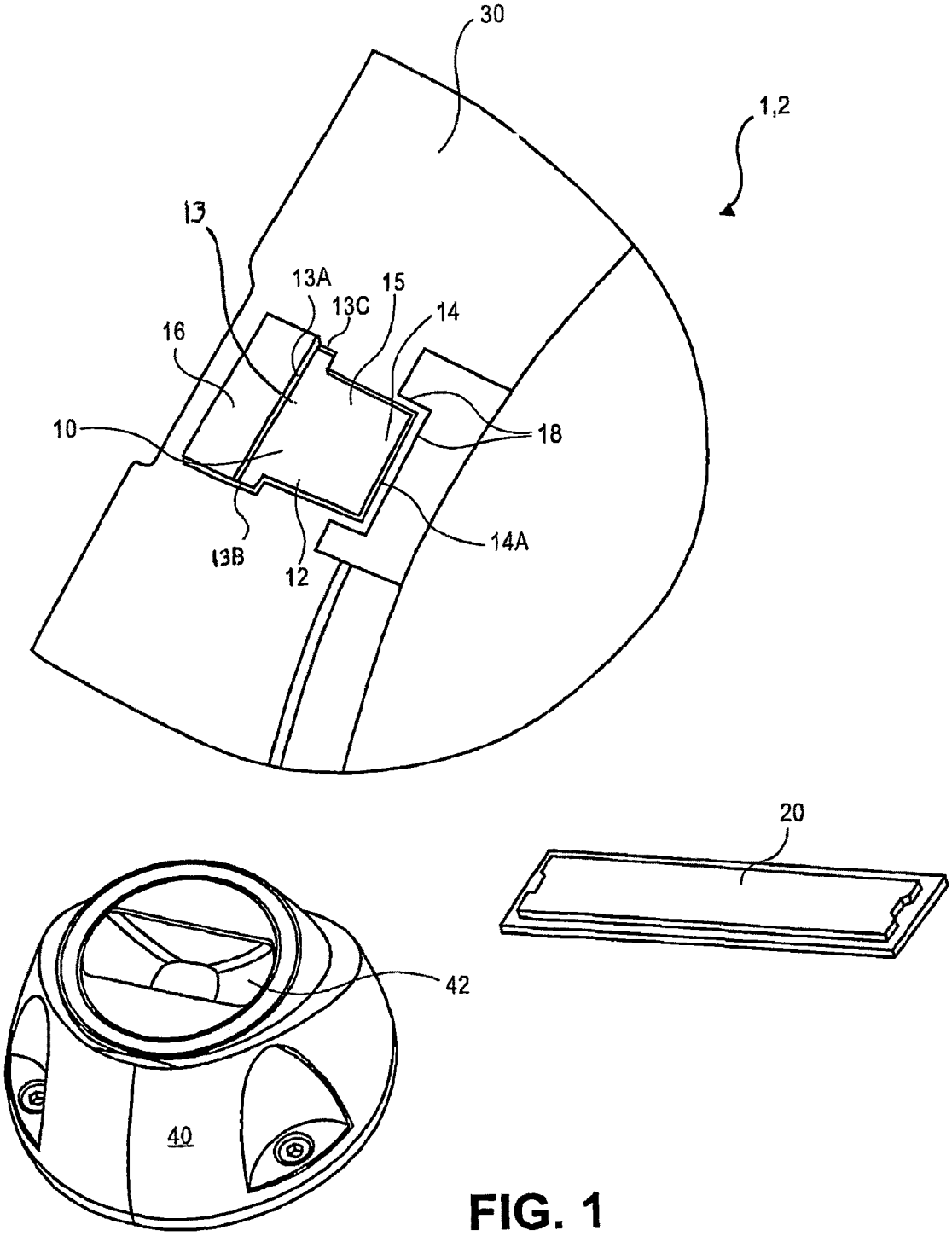
FIG. 1 illustrates components of a security device and system, in accordance with one embodiment.
Figure 1A:
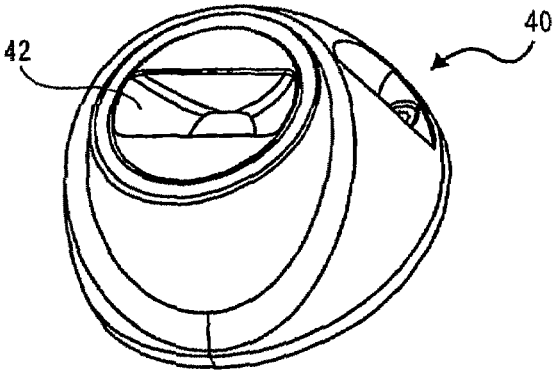
FIG. 1A illustrates a perspective view of a detacher, in accordance with one embodiment.
Figure 1B:
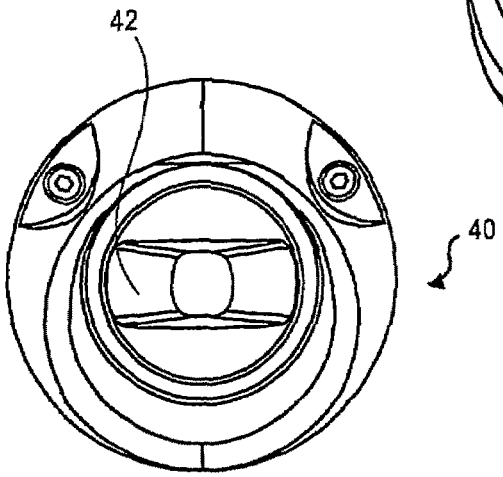
FIG. 1B illustrates a top view of a detacher, in accordance with one embodiment.
Figure 1C:
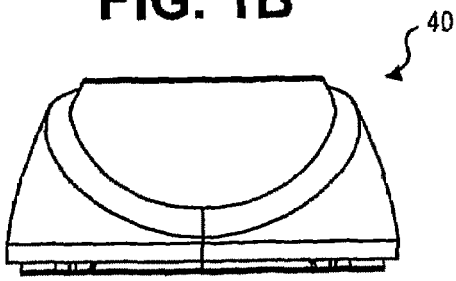
FIG. 1C illustrates a front view of a detacher, in accordance with one embodiment.
Figure 1D:
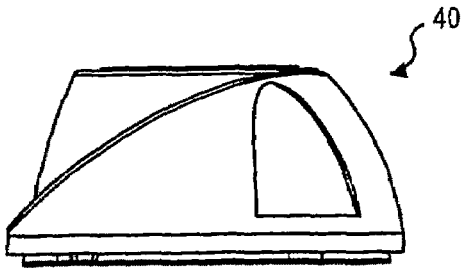
FIG. 1D illustrates a side view of a detacher, in accordance with one embodiment.

Referring now in detail to the drawings wherein like parts are designated by like reference numerals throughout, there is illustrated in FIG. 1 a front view of components that may be included in a security system 1 and a security device 2 in accordance with one embodiment. In this embodiment, the security system 1 includes the security device 2 and a detacher 40. The security device 2 may include a locking mechanism 10, security tag 20, and housing 30.

The locking mechanism 10 may be a magnetically actuable locking mechanism, and may include a magnetically actuable latch 12, flexible element 16, and latch mating element 18.

The magnetically actuable latch 12 may include a base portion 13, which may include a base portion end 13A and side surfaces 13B and 13C; and a latching portion 14, which may include a latching portion end 14A; and a central portion 15.

The magnetically actuable latch 12 may have a substantially rectangular-shaped face such that the base portion 13 has the same width as both the latching portion 14 and central portion 15. Thus, the width of the base portion 13, or the distance between the side surfaces 13B and 13C, may be the same as the corresponding widths of the latching portion 14 and central portion 15. In other embodiments, the widths of the base portion 13, latching portion 14, and central portion 15 may differ. The magnetically actuable latch 12 may have a slender, uniform cross-section.

However, the magnetically actuable latch 12 may be configured as desired, may comprise one or more pieces, and may be symmetrical or unsymmetrical about any point, line, or plane. For example, in various embodiments the magnetically actuable latch 12 may be configured with a "T", "I", curved, or other shape of face and with a rectangular, circular, thick, hollow or otherwise voided, and/or non-uniform cross-section, or as shown and/or described herein with respect to embodiments of the any of the magnetically actuable latches, such as 112, 512, 912, 1512, and 2112. In another embodiment, the latching portion end 14A of the magnetically actuable latch 12 may include one or more teeth, ribs, notches, jags, points, curves, voids, or other shapes such as those shown and/or described herein with respect to embodiments of the magnetically actuable latches 112, 512, 912, 1512, and 2112, while the base portion end 13A may be flat or another shape. In addition, the base portion end 13A may be continuous or discontinuous. The magnetically actuable latch 12 may be configured such that at least a portion of it, such as the latching portion 14, may engage, receive, insert into, or otherwise mate with the latch mating element 18, such as described herein.

In one embodiment, a security device 2 includes multiple magnetically actuable latches 12, which may be disposed, possibly each along with another flexible element 16 and latch mating element 18, in the same or different portions of the security device 2. For example, in one embodiment, the multiple magnetically actuable latches 12 may each cooperate with another portion of the security device 2 to lock the portion, such as, for example, a portion securing an article or a portion securing a security tag 20.

The magnetically actuable latch 12 may comprise or may be formed of a magnetic material such as iron, nickel, or cobalt, or an alloy of iron, nickel, or cobalt. In one embodiment, the magnetically actuable latch 12 includes one or more magnetic materials and may also include one or more non-magnetic materials.

The flexible element 16 may be shaped as desired, such as in a cuboid, ellipsoid, coil, or any other shape such as shown and/or described herein with respect to the embodiments of the flexible elements 116, 516, 916, and 1516, and may include one or more pieces, or may be combined or integrally formed with the magnetically actuable latch 12. In one embodiment, the flexible element 16 may be shaped as a cantilever arm, such as, for example, a leaf spring. The flexible element 16 may comprise or may be formed of a flexible material such as a light, porous, semirigid, elastic, gaseous, and/or spongy material that may provide a resistant force when compressed and may partially or fully recover its uncompressed shape when the compressive force is removed. For example, in various embodiments, the flexible element 16 may comprise or may be formed of a foam rubber, polymeric foam, ceramic foam, or other foam; a rubber; and/or another material or materials. The flexible element 16 may also or alternatively be configured to provide the resistant force when compressed. For example, in various embodiments the flexible element 16 may be configured as a coil, leaf or other cantilevered arm, or other spring, or other like member, that comprises a metal, polymer, ceramic, and/or another material or materials. The flexible element 16 may have any of various masses.

The latch mating element 18 may be configured as desired, such as with one or more holes or other voids, ribs, teeth, protrusions, or other shapes. The latch mating element 18 may include one or more pieces, and may be separate from or integral with the housing 30, such as described herein. The latch mating element 18 may be configured to engage, receive, insert into, or otherwise mate with at least a portion of the magnetically actuable latch 12. For example, in an embodiment where the magnetically actuable latch 12 is a slender member with a rectangular shape of face, the latch mating element 18 may be configured with a void in which the latching portion 14 of the magnetically actuable latch 12 or a part thereof may be inserted into the locking position, as described herein. In an embodiment where the magnetically actuable latch 12 is toothed at its latching portion end 14A, the latch mating element 18 may be configured with ribs that engage the teeth in the locking position.

The security tag 20 may be any detectable device or system, such as any security tag or label. For example, in various embodiments the security tag 20 may be any type of EAS tag (e.g., Radio Frequency (RF) tag, acousto-magnetic tag, and/or combinations thereof), Radio Frequency Identification (RFID) tag, smart tag, or other detectable anti-theft or other tag. For example, the security tag 20 may be a combination of two or more such tags. In one embodiment, the security tag 20 is a combination EAS and RFID tag comprising both EAS and RFID technologies.

The security tag 20 may be detectable by a corresponding detecting system or device, such as, depending on the type of security tag or label, an acousto-magnetic detector, electromagnetic detector, radio frequency detector, or other detector, or a combination of more than one detector.

The housing 30, as partially shown in the embodiment of FIG. 1, may be any casing or other structure that partially or fully contains and/or surrounds, encloses, affixes to, interlocks with, or otherwise secures the locking mechanism 10 and security tag 20, and, when the locking mechanism 10 is in the locking position and the housing is thereby locked, an article. The housing 30 and locking mechanism 10 may thus cooperate to secure, or lock, the article to the housing 30, and thus the security device 2. The housing 30 may be configured as desired, and may be shaped based upon the shapes of the locking mechanism 10, security tag 20, and article for which it is designed to secure, such as described herein with respect to the embodiments of the housings 130, 530, 930, and 1730. The housing 30 may include the latch mating element 18, which may be integral with the housing 30. The housing 30 may alternatively be configured to pair with the latch mating element 18. The housing 30 may comprise a polymer and/or another material or materials.

The components included in the security device 2 may be configured such that the security device 2 may lock to an article, such as described with respect to the security device embodiments below. The security tag 2 may be reusable or may be for one-time use.

FIGS. 1A-1D illustrate a perspective, top, front, and side view of the detacher 40 shown in FIG. 1, in accordance with one embodiment. The detacher 40 may be a device that includes and houses a magnet 42. The magnet 42 may be any type of magnet, such as any permanent magnet or electromagnet, or a combination thereof, for example. Regarding the security system 1, the detacher 40 may be employed with the security device 2 to unlock the security device 2 from an article. The detacher 40 may be positioned appropriately near the magnetically actuable latch 12 of the security device 2 to magnetically force the magnetically actuable latch 12 away from the locking position, thus allowing the housing 30 of the security device 2 to be removed from an article to which it may be locked.

In various embodiments, the detacher 40 may include different magnets 42. For example, the magnet 42 of the detacher 40 may be selected based upon the magnetic force needed to move the magnetically actuable latch 12 away from the locking position, thus unlocking the security device 2. This magnetic force may need to more than offset the forces opposing the movement. Such opposing forces may include, for example, the resistant force provided by the flexible element 16 when it is compressed by the magnetically actuable latch 12, frictional forces caused by the magnetically actuable latch 12 contacting the housing 30 and/or another element during movement, and other forces. In another embodiment, where a detacher 40 is intended to be used on various security devices having different configurations, such as one or more of the security device embodiments 2, 102, 502, 902, 1702, and 2102 described herein, a magnet 42 may be selected that is strong enough to unlock the security device requiring the strongest magnet to unlock it.

Figure 20:
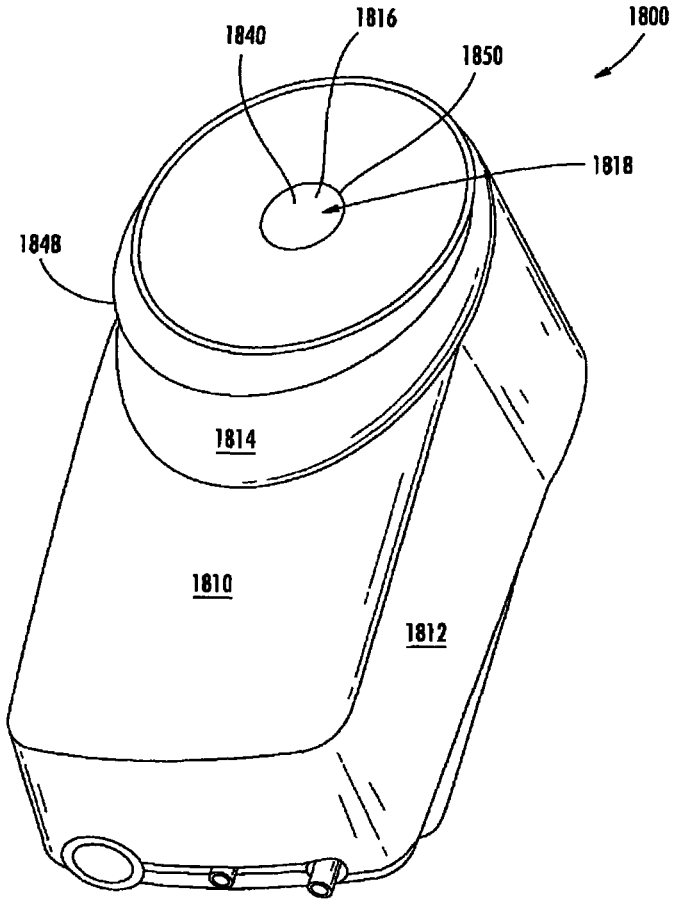
FIG. 20 illustrates a perspective view of a detacher, in accordance with one embodiment.
Figure 21:
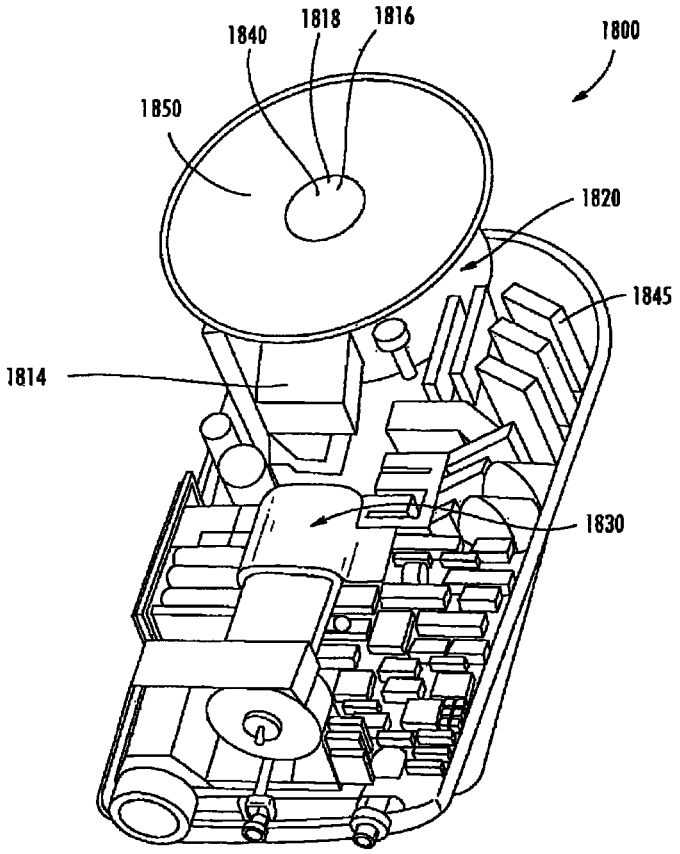
FIG. 21 illustrates a perspective view of a detacher with part of its housing shown transparently to make the detacher interior visible, in accordance with one embodiment.
Figure 22:
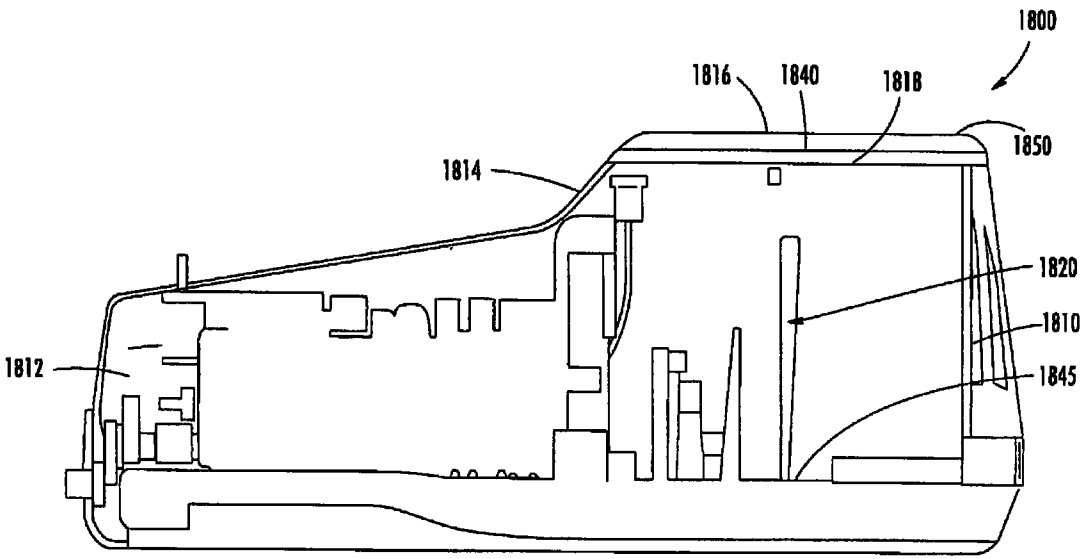
FIG. 22 illustrates a side view of a detacher with part of its housing shown transparently to make the detacher interior visible, in accordance with one embodiment.

In another embodiment, a detacher 1800, such as described with respect to the embodiments of FIGS. 20-22, may be employed to unlock the security device 2 from an article. The magnetically actuable latch 12 of the security device 2 may be positioned appropriately near the detacher 1800 to magnetically force the magnetically actuable latch 12 away from the locking position, thus allowing the housing 30 of the security device 2 to be removed from the article.

The detacher 1800 may include a detacher housing 1810 and a magnet 1820. The detacher 1800 may also include a motor 1830 coupled with the magnet 1820, and which may move the magnet 1820, such as described below.

FIG. 20 illustrates a perspective view of the detacher 1800, in accordance with one embodiment. The detacher housing 1810 may have an at least partially rectangular lower portion 1812, and may have a rounded upper portion 1814 that may be partially cylindrical and have a circular, planar top end 1816. The upper portion 1814 may include a nest 1818, such as described below, to receive a portion of one or more types of security devices, such as those described herein. The nest 1818 may include a rounded hole or other shape of recess in the top end 1816 of the upper portion 1814, and may comprise an at least partially cylindrical recess bounded by the nest wall 1840. In various other embodiments, the nest 1818 may be other shapes of areas, either two or three-dimensional, that may or may not comprise a recess in the detacher housing 1810. In other embodiments, the detacher 1800 may otherwise include one or more variously-shaped areas in which at least a portion of a security device may be positioned for unlocking, such as described with respect to the nest 1818. The area or areas may be positioned adjacent the detacher housing 1810, such as within, at, and/or near the detacher housing 1810

However, the lower portion 1812, upper portion 1814, top end 1816, and nest 1818 may be variously shaped in other embodiments, and may be shaped to conform to a variety of shapes of security devices. For example, the nest 1818 may be shaped and sized to be able to receive at least a portion, possibly in a certain orientation or within a range thereof, of one or more security devices such as 2, 102, 502, 902, 1702, and 2102, used to secure a variety of articles. Each such security device portion may include a volume of a security device adjacent to and/or including its magnetically actuable locking mechanism. The detacher housing 1810 may, in various embodiments, comprise one or more separate parts, which may be secured to each other or otherwise to the detacher 1810 by one or more of welding, fusing, gluing, taping, snap-fit, interference fit, and other securing means.

The detacher housing 1810 may comprise one or more plastics and other nonmagnetic materials, which may minimize interference with the interaction between the magnetically actuable latch of a security device described herein and the magnet 1820 as the security device is being unlocked. However, in various embodiments, one or more magnetic materials, such as certain metals, alone or in combination with one or more nonmagnetic materials, may be included in the detacher housing 1810.

In one embodiment, the detacher housing 1810 may comprise a retail counter, a table, a desk, or another structure or structures, or a portion thereof. For example, the detacher housing 1810 may comprise a portion of a counter top, and possibly surrounding portions of the counter housing or other support. One or more portions of the detacher 1800 described below and herein, such as the magnet 1820, motor 1830, shield, security tag antenna 1848, security tag reader, and/or infrared or other proximity detector, for example, may be coupled with the countertop and/or to each other. The coupling may be by way of a flush mount or other mount, or other method of affixation, for example. The portions of the detacher 1800 may be coupled vertically, horizontally, or in another orientation. In an embodiment, the structure, structures, or portions thereof comprising the detacher housing 1810 may enclose or otherwise secure some or all of the detacher 1800 portions.

FIGS. 21-22 respectively illustrate a perspective view and side view of a detacher 1800, in accordance with one embodiment. For purposes of discussion, FIGS. 21-22 show part of the housing 1810 as transparent so that the detacher 1800 interior is visible. The magnet 1820 may be any type of magnet such as described with respect to the magnet 42 of the detacher 40 described herein. For example, the magnet 1820 may be a permanent magnet as shown in the embodiments of FIGS. 21-22, or may be an electromagnet, or may be a combination of a permanent magnet and an electromagnet. The magnet 1820 may be of any desired strength. For example, in one embodiment, the magnet 1820 can provide a magnetic field of at least 7-8 or more kilogauss, such as 8.3 kilogauss.

A motor 1830 may drive or otherwise be coupled with the magnet 1820, such that the motor 1830 may operate to move the magnet 1820, and to thus move the magnet 1820 relative to the housing 1810 and thus the nest 1818. The motor 1830 may move the magnet 1820 in a direction perpendicular or close to perpendicular to the top end 1816 of the detacher housing 1810 in an embodiment where the top end 1816 is planar. In an embodiment where the nest 1818 is partially cylindrical as described above, the central axis of the cylindrical portion may be perpendicular or close to perpendicular to the planar top end 1816. Thus, the magnet 1820 may move parallel to the central axis of the cylindrical portion. In one example, a magnet's magnetic field strength at a point may vary in an inverse relationship to the distance from the magnet. For example, the magnetic field strength may vary approximately inversely to the square of the distance from the magnet 1820 or otherwise in a roughly exponential inverse relationship relative to such distance. In this example, such movement of the magnet 1820, even a short distance, may significantly alter the magnetic force that will be applied on a magnetically actuable latch 12 positioned near or at least partially within the nest 1818.

In one embodiment, the detacher 1800 may include a shield for the magnet 1820. The shield may obstruct the magnetic field of the magnet 1820 from being emitted in certain directions or areas, and may focus the magnetic field, or a portion thereof, in the nest 1818 or other area. The shield may be mounted to, or otherwise coupled with or disposed within, the detacher housing 1810 or another portion of the detacher 1800. The shield may comprise one or more magnetic materials, and may also comprise one or more nonmagnetic materials.

In another embodiment, the motor 1830 may move the magnet 1820 in a direction other than perpendicular or close to perpendicular to the top end 1816, but still in a direction toward or away from the nest 1818. The position of the magnet 1820 relative to the nest 1818 may determine whether there exists a sufficient magnetic field within or near the nest 1818 to open a security device.

For example, as shown in the embodiment of FIG. 22, the magnet 1820 is positioned at an uppermost position relative to the detacher housing floor 1845, or at its position nearest the top of the nest 1818, where the nest wall 1840 meets the top end 1816 of the detacher 1800. In this position, the magnet 1820 provides a stronger magnetic field in the nest 1818 than in any other position. If the motor 1830 operates to move the magnet 1820 away from the top of the nest 1818, the magnetic field strength in the nest 1818 will decrease.

In another embodiment, the magnet 1820 moves relative to the housing 1810 and thus the nest 1818 as described above, but instead of the magnet 1820 moving, the housing 1810 moves. The motor 1830 or another motor may be coupled with the housing 1810, and the magnet 1820 may be secured to a portion of the detacher 1800 other than the housing 1810. In another embodiment, the magnet 1820 and housing 1810 may each have a motor to cause its movement.

In one embodiment, the detacher 1800 may operate with point-of-sale (POS) equipment or a system, such as a system including a POS device or devices at a retail check-out lane (e.g., a POS terminal, a bar code scanner or other retail scanner) and a computerized network coupled thereto. For example, in one embodiment, a security system includes the detacher 1800 and the POS system or a portion thereof, and may also include or be employable with one or more of the security devices 2, 102, 502, 902, 1702, and 2102 described herein, for example.

In this embodiment, the system may set a default position of the magnet 1820 within the detacher 1800. The default position may be at least enough distance from the nest 1818 such that the magnetic field strength it provides within the nest 1818 is insufficient to force movement of a magnetically actuable latch of any security device positioned therein. When an article having a security device secured thereto has its bar code or other identifier, which may be included as part of the security tag, scanned or otherwise entered into the POS system during sale to a customer, the system may identify the article and may designate the security device as authorized for removal. The security system may then enable the detacher 1820 by prompting the motor 1830 to move the magnet 1820 closer to the nest 1818, to a position in which the magnet 1820 provides a magnetic field strong enough to unlock the security device. When the magnetically actuable latch of the security device is positioned near or within the nest 1818 and oriented such that the resultant magnetic force will move the latch away from the locking position, the security device may be unlocked and removed from the article. In various embodiments, the magnetic field strength and resultant magnetic force, along with the force required to unlock the security device, may be customized by varying the size, shape, positioning, and/or material of one or more of the magnet 1820, magnetically actuable latch, and biasing element, for example. As described above with respect to the detacher 40 and security device 2, for example, the force needed to move the magnetically actuable latch 12 may also include various other components such as movement-opposing frictional forces and other forces.

In various other embodiments, the criteria for authorizing removal of the security device from the article may be set by a security system manager or other user as desired.

In another embodiment, the security system includes, in addition to the detacher 1800, POS system or portion thereof, and one or more security devices such as 2, 102, 502, 902, 1702, and 2102 described herein, a security tag interrogator or portion thereof. The security tag interrogator may include a security tag antenna and a security tag reader. In one embodiment, the interrogator, or one or more components thereof, is included as part of, and disposed within or otherwise coupled with, the detacher 1800. For example, the security tag reader may be positioned near or within the detacher housing 1810. The antenna may be embedded, positioned within, or otherwise disposed in the detacher housing 1810 near the nest 1818, such as in the position of the antenna 1848.

In one embodiment, the antenna 1848 may be positioned between the top end 1816 of the detacher housing 1810 and the magnet 1820. In another embodiment in which a shield is included for the magnet 1820, such as described above, the antenna 1848 may be positioned between the shield and the top end 1816 of the detacher housing 1810.

In one embodiment, the security tag reader and antenna are both disposed or embedded in the detacher 1800 and are coupled to each other by cable or wirelessly. In another embodiment, the security tag reader, antenna, or both are disposed outside of the detacher. For example, the security tag reader and antenna may both be mounted next to the detacher 1800.

In an embodiment of the security system having a security tag interrogator or portion thereof, the security devices used may each include a security tag that is an RFID tag, and the security tag read by the antenna and reader may respectively be an RFID antenna and RFID tag reader. Where a security device 2, for example, has been authorized for removal from a scanned article such as described above, the security system may require the RFID tag of the security device 2 to be detected by the RFID antenna and read by the RFID tag reader before enabling the detacher 1800. When the security device 2 is positioned such that the magnetically actuable latch 12 is near or at least partly within the nest 1818 of the detacher 1800, the RFID antenna and tag reader may cooperate to obtain information from the RFID tag of the security device 2. That information may be processed by the security system, which may then enable the detacher 1800 by prompting appropriate movement of the magnet 1820 to unlock the security device.

In one embodiment, that information may include a category of articles or types of articles, e.g., "circular optical discs," to which a security device having that security tag may be secured. If the article scanned is included within that category, the security system may then enable the detacher 1800 to unlock the security device. Such a system may prevent a less expensive article from being scanned while a security device securing a more expensive article is removed using the detacher 1800. Thus, the RFID antenna and tag reader, through a positive sensing and reading of the RFID tag, can determine if the magnet 1820 should be positioned up, in an enabled position closer to the nest 1818, or if the request to enable the detacher 1800 is unauthorized, in which the detacher 1800 is to remain disabled in the down position. In an embodiment where the RFID tag of a security device includes an embedded bar code or other article identifier, the RFID antenna and tag reader can cooperate to identify the specific article secured by the security tag to be detached. In this embodiment, the security system may only enable the detacher 1800 if the identified article matches the identity of the article that was scanned for sale. If the security system either did not recognize the security tag read or identified an article other than the article scanned, the security system may be designed to automatically alert a store manager such as by pager or email, or alternatively activate controllable cameras to record the event for later review.

In various other embodiments of the security system, the criteria for enabling the detacher 1800 may be further or alternatively customized. For example, in one embodiment, the detacher 1800 may be automatically enabled when a cashier or other user successfully logs on to a POS terminal. In another embodiment, the system may operate such that the detacher 1800 is enabled for only a limited time once a valid ID barcode or other identifier of an article has been scanned by the POS system or device. In one embodiment, any of the aforementioned enablement criteria may be overridden by a manager or other user, such as by a keyed switch.

In another embodiment, the security tag antenna and reader may be for a security tag other than an RFID tag, or for a combination of tags or their respective technologies. For example, the security tag antenna and reader may be for a combination EAS and RFID tag, and may thus combine sensing and reading abilities for both EAS and RFID technologies.

In another embodiment, a security tag used in the security system may be a combination security tag, but the security tag antenna and reader may only operate with one of the technologies. In this embodiment, another antenna and reader, included in or external to the security system, may operate with the other technology.

In another embodiment, the detacher 1800 and/or the security tag antenna and reader may include an integral bar code scanner or other article identifier. In this embodiment, the security system may or may not otherwise include a bar code scanner or other article identifier with its POS system. However, the security system may include both article identifiers to further bolster the security system.

In another embodiment, the security system may provide user-selectable operational modes to enable the detaching of some security devices, such as those having non-intelligent security tags, while preventing the detaching of security devices having other security tags, such as certain RFID security tags and/or other intelligent security tags, until an RFID security tag authorizing removal of its associated security device is recognized.

For example, in one embodiment, the security system may designate discrete positions of the magnet 1820 relative to the nest 1818. The security system may associate these positions with different categories of security devices and/or their associated articles to be secured. The security system may prompt movement of the magnet 1820 to appropriate positions, based upon information scanned from the article identifiers or read from the security tags as described above and herein. The system may designate a bottom most position of the magnet 1820 relative to the detacher housing floor 1845, or position of greatest distance from the nest 1818, such that the detacher 1800 cannot unlock any security tag positioned at least partially within the nest 1818.

The security system may designate a magnet 1820 intermediate position in which the detacher 1800 can unlock only certain of the security devices 2, 102, 502, 902, 1702, and 2102, for example, positioned near or at least partially within the nest 1818. The intermediate position may be designated for lower-level security devices, such as those to be attached to inexpensive items. Lower-level security devices may include magnetically actuable locking mechanisms configured such that they may be unlocked when subjected to the magnetic field in or near the nest 1818 when the magnet 1820 is in the intermediate position. For example, a lower-level security device 2 may include a magnetically actuable locking mechanism 10 designed to be unlocked with a relatively lower magnetic field. For example, the magnetically actuable locking mechanism 10 may include a magnetically actuable latch 12 that has a low mass and/or or is highly magnetic; a resilient element 16 that is easily compressible; and/or a configuration that minimizes friction when the magnetically actuable latch 12 moves.

The security system may also designate a top or highest magnet 1820 position, or position of least distance from the nest 1818, to provide the greatest magnetic field strength within or near the nest 1818. When the magnet 1820 is in this highest position, the detacher 1800 may unlock all lower-level security devices, such as 2, 102, 502, 902, 1702, and 2102, positioned partially within or near the nest 1818. Additionally, the magnet 1820 may be able to lock some or all higher-level security devices 2, 102, 502, 902, 1702, and 2102 that the detacher 1800 may be unable to unlock when its magnet 1820 is in the intermediate position. Articles secured by higher-level security devices may be more expensive than those secured by lower-level security devices, for example.

In one embodiment, the magnet 1820 is an electromagnet, and its position may be adjusted such as described above, or alternatively its electric current may be altered to effect an equivalent magnetic field change in the nest 1818 of the detacher 1800.

In another embodiment, the system may have less or more than three discrete magnet 1820 positions, and the positions may be customizable such that positions can be added or removed by a manager or other user, or automatically determined by the security system.

In various embodiments, a plurality of security devices, such as any combination of security devices 2, 102, 502, 902, 1702, and 2102, are each designated into one of a discrete number of "security levels" that correspond to a different magnet 1820 position. The security levels may correspond to the articles designated to be secured by the security devices, and may be each be based upon the article's value, type, popularity or likelihood of theft, difficulty in stealing (e.g., small, light articles may be relatively easy to hide), other criteria, or any combination thereof as desired.

Thus, for example, a plurality of circular optical disc security devices 102, such as described below, may each be provided a security level based upon the type of circular optical disc to be secured thereto. As another example, bottle security devices 1702 described below may be designated in various security levels based upon the prices or profit margins of the wines in the bottles they are to secure, and one or more of these security levels may be the same as one or more of those associated with the circular optical disc security devices 102.

The aforementioned capability of embodiments of the security system to restrict operation of the detacher 1800 may enable retailers to combat collusion at the point of sale. Collusion may be accomplished, for example, by a store associate scanning a first article and then removing a security device from a more expensive article, which may then be removed from the store. Thus, where a less expensive item is scanned, the security system may prompt the detacher 1800 to only raise the magnet assembly to a lower height, or greater distance from the nest 1818, commensurate with a lower security article. At such height, the magnetic field strength in the nest 1818 may be insufficient to unlock the security device associated with a higher security article. In an embodiment, after the detacher 1800 performs an authorized unlocking of a security device such as described herein, the magnet 1820 immediately moves to an "off" position such that it will not provide sufficient field strength within the nest 1818 to unlock any security device, such as 2, 102, 502, 902, 1702, or 2102. One or more infrared sensors or other proximity sensors 1850, or other types of sensors, may be positioned within or adjacent to the nest 1818 and may sense when a security device is inserted in and removed from the nest 1818. Once removed, the magnet 1820 may be prompted by the security system to be lowered by the motor 1830 to an "off" position, thus preventing quick removal of multiple security devices from multiple articles while the detacher is enabled. In addition or alternative to the sensors 1850, an EAS marker or detector may be positioned within or adjacent the nest 1818 to detect the presence of an EAS tag of a security device.

In another embodiment, where the electricity or other power to the detacher 1800, such as to the motor 1830, is cut off, the magnet 1820 automatically moves to its "off" position. For example, the magnet 1820 may be biased toward its off position by gravity, spring, reserve power such as a battery, or other means, such that if the motor 1830 is not at least operating to at least offset this bias, the magnet 1820 will move toward and to its "off" position. In another embodiment, the magnet 1820 automatically moves to its "off" position after power returns to the detacher 1820.

Figure 1E:
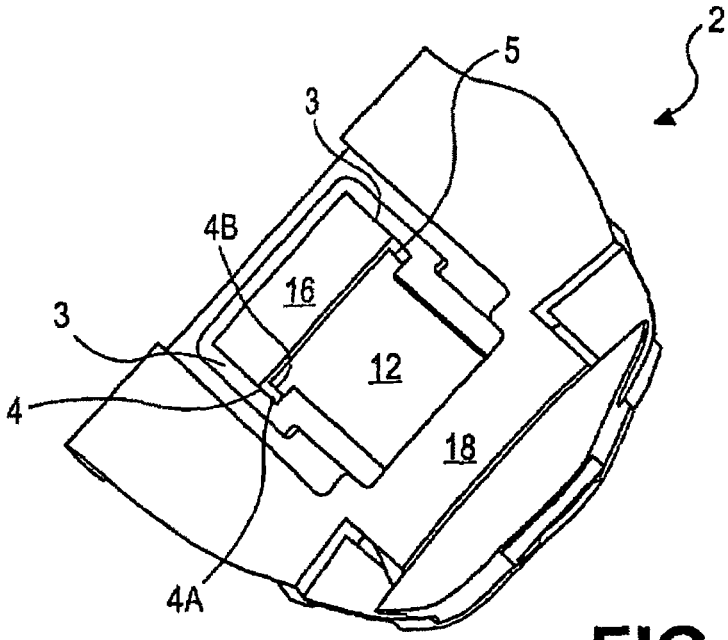
FIG. 1E illustrates a perspective view of a portion of a security device configured for one-time use.
Figure 1F:
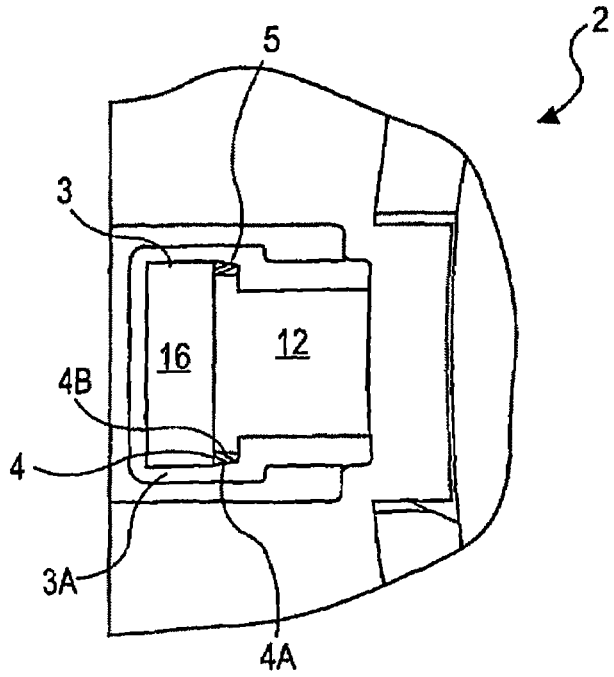
FIG. 1F illustrates a top view of portion of a security device configured for one-time use.
Figure 1G:
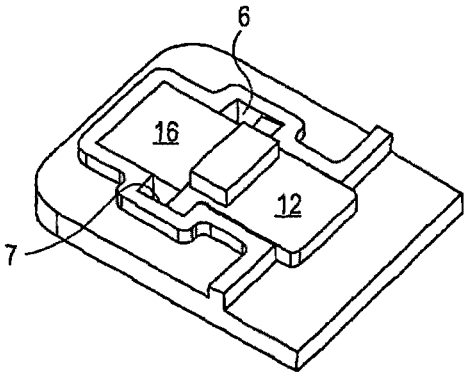
FIG. 1G illustrates a perspective view of a portion of a security device configured to be resettable.
Figure 1H:
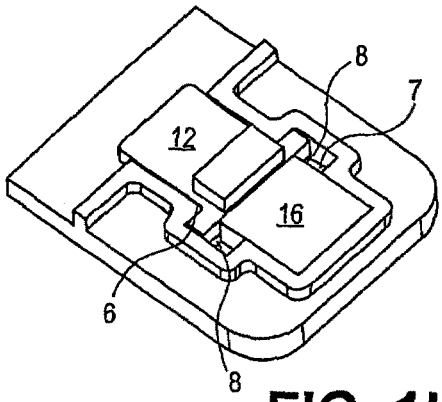
FIG. 1H illustrates a perspective view of a portion of a security device configured to be resettable.
Figure 1I:
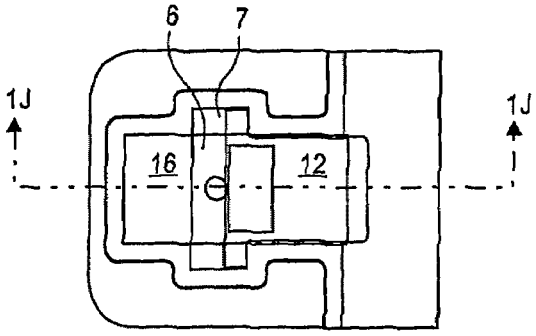
FIG. 1I illustrates a top view of a portion of a security device configured to be resettable.
Figure 1J:
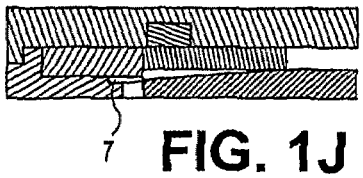
FIG. 1J illustrates a front view of a portion of a security device configured to be resettable.

In one embodiment, the security device 2 may be configured for one-time use. For example, in one embodiment as shown in FIGS. 1E-1F, the magnetically actuable latch 12 of the security device 2 may be positioned within a channel 3 as mated with the latch mating element 18 in the locking position. One or more leaf springs or other cantilevered arms, such as the cantilevered arms 4 and 5, are disposed in the channel 3 in a spring-loaded configuration.

For example, the cantilevered arm 4 may have an unloaded position as shown in FIG. 1E. The cantilevered arm may be bent to a position with its side 4A adjacent the channel wall 3A, and thus spring-loaded. The magnetically actuable latch 12 may then be disposed in the channel 3 in the locking position adjacent its other side 4B, preventing the cantilevered arm 4 from moving and preserving its spring load. The cantilevered arm 5 may be similarly positioned. Where the magnetically actuable latch 12 is then moved out of the locking position by the detacher 1800 or 40, for example, the cantilevered arms 4 and 5 may no longer be constrained by the magnetically actuable latch 12 and may spring back or otherwise return to their unloaded positions. Where in these positions the cantilevered arms 4 and 5 extend into the channel 3 such that they may block the base portion 13 of the magnetically actuable latch 12 from moving past them, the magnetically actuable latch 12 may not be able to return to the locking position. Thus, any appended security device may no longer be able to lock.

In another embodiment, only one of the cantilevered arms 4 and 5 is included. In various other embodiments, other resilient elements, such as coils or other springs, rubbers, and foams, for example, may be employed within the channel 3 or other portion of the housing to prevent the appended security device from being used twice.

In another embodiment such as shown in FIGS. 1G-1J, the locking mechanism portion and housing portion may be configured such that after each instance the magnetically actuable latch 12 is moved out of the locking position, the magnetically actuable latch 12 may need to be reset to enable it to be repositioned in the locking position. For example, the magnetically actuable latch 12 may be disposed in a channel 6 with its base end 13A adjacent a recess 7. The recess 7 may be configured such that where the magnetically actuable latch 12 is biased out of the locking position, at least a portion of the magnetically actuable latch 12 falls or is otherwise urged into the recess 7. The recess may be delineated by a wall 8 that may restrict movement of the magnetically actuable latch 12 back toward the locking position. In this embodiment, the security device in which the magnetically actuable latch 12 is disposed may be "reset" for use, such as by employing a magnet that may move the magnetically actuable latch 12 out of the recess.

FIGS. 2-9 illustrate various perspective views of a circular optical disc (OD) security device 102 (or a portion thereof) that may comprise a locking mechanism 110, security tag 120, and housing 130, in accordance with one embodiment. As used herein, the terms "circular optical disc" and "circular OD" refer to the following: any type of compact disc, including, for example, a Compact Disc (CD), Compact Disc Read Only Memory (CD-ROM), Mini CD-ROM, Compact Disc Recordable (CD-R), and Compact Disc Rewritable (CD-RW); any type of Digital VideoDisc or Digital Versatile Disc (DVD), including, for example, a DVD, DVD Read Only Memory (DVD-ROM), DVD Recordable (DVD-R), High Definition DVD (HD-DVD); any other optical disc that may be at least partially cylindrical in shape with a central hole, or an optical disc that is flat and has a circular perimeter or is otherwise shaped like a CD or DVD or as any aforementioned CD or DVD type, including, for example, a Blu-ray disc (BD), BD Rewritable (BD-RE), BD Recordable (BD-R), and BD Read Only Memory (BD-ROM). In various other embodiments, the security device 102 (or a portion thereof), the locking mechanism 110, and the security tag 120 may be adapted to other articles such as non-circular optical discs, non-optical discs, and/or any other object formed in various geometric shapes and sizes.

Figure 2:
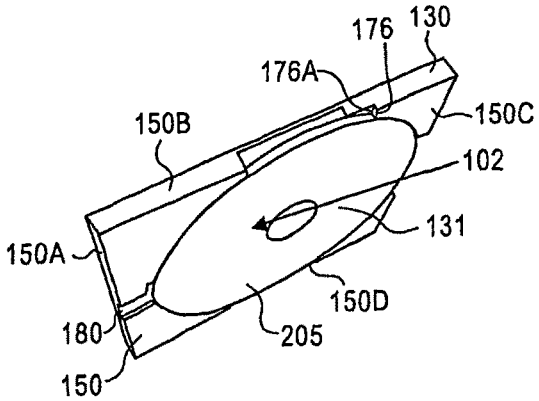
FIG. 2 illustrates a perspective view of a circular optical disc (OD) security device, in accordance with one embodiment.
Figure 3:
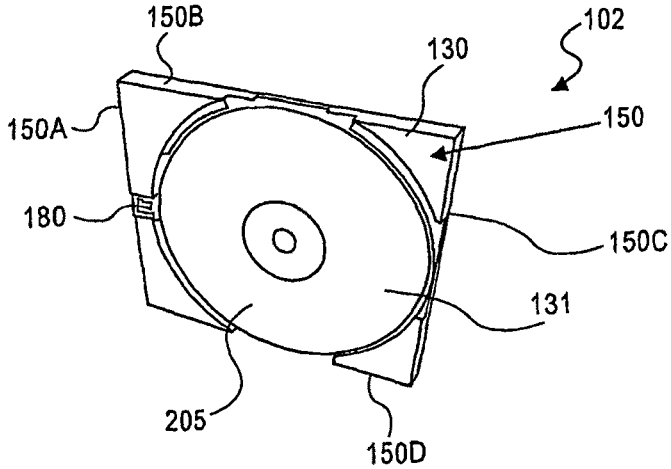
FIG. 3 illustrates a perspective view of a circular OD security device, in accordance with one embodiment.
Figure 4:
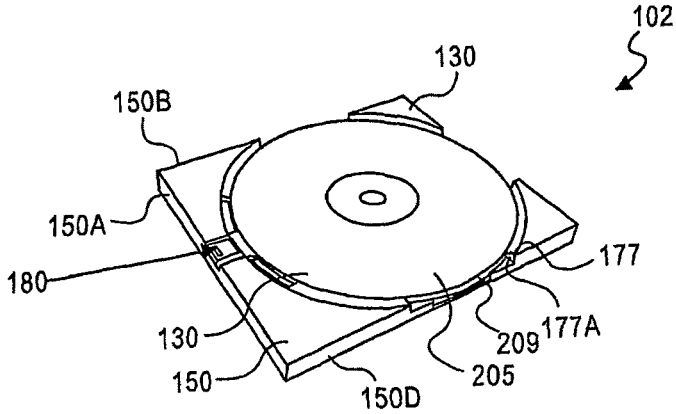
FIG. 4 illustrates a perspective view of a circular OD security device, in accordance with one embodiment.

The housing 130 shown in the embodiment of FIGS. 2-4 may have an outer shape at least partially like a cuboid, and may have an outer face 131 that is at least partially rectangular, and possibly also at least partially square, in shape. The housing 130, in various embodiments, may have an outer shape at least partially like any type of CD, DVD, BD, or other circular OD casing, or may have another shape. The housing 130 may be shaped and otherwise configured to partially or fully contain, enclose, affix to, or otherwise secure each of the locking mechanism 110, security tag 120, and an article that is a circular OD to the housing 130.

Figure 11A:
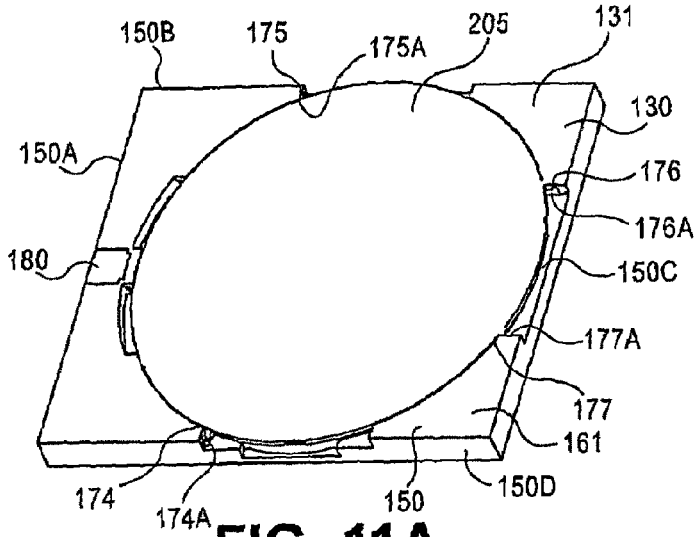
FIG. 11A illustrates a perspective view of a housing of a circular OD security device, in accordance with one embodiment.
Figure 11C:
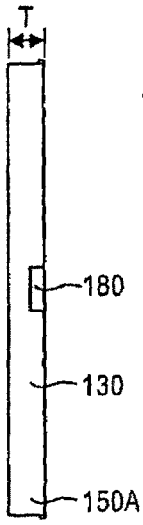
FIG. 11C illustrates a left side view of a housing of a circular OD security device, in accordance with one embodiment.
Figure 11B:
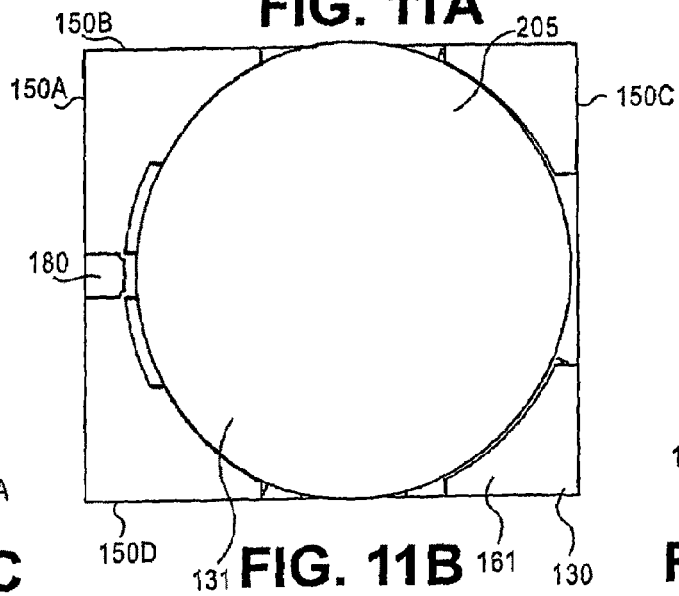
FIG. 11B illustrates a top view of a housing of a circular OD security device, in accordance with one embodiment.
Figure 11D:
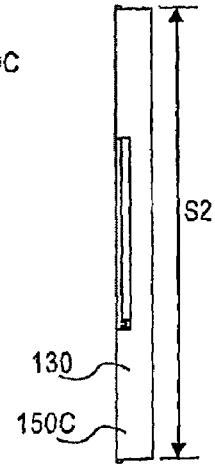
FIG. 11D illustrates a right side view of a housing of a circular OD security device, in accordance with one embodiment.
Figure 11E:
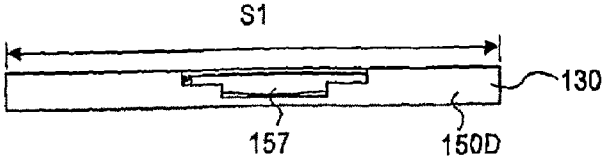
FIG. 11E illustrates a front view of a housing of a circular OD security device, in accordance with one embodiment.

For example, FIGS. 11A-11E illustrate a perspective, top, left side, right side, and front view, respectively, of one embodiment of a housing 130. The housing 130 may have a slender thickness T, As shown in FIGS. 11C-11E, as compared to the dimensions of the outer face 131, as shown in FIG. 11B. In one embodiment, the thickness T may be approximately 10.27 mm, and the face may have the approximate side dimensions S1 and S2 of 142.33 mm and 124.86 mm, respectively. The housing 130 in this embodiment may be shaped at least partially like a CD case or other circular OD case.

FIGS. 5-9 illustrate perspective views of embodiments of portions of the circular OD security device 102. FIGS. 10-13 illustrate other views of embodiments of the circular OD security device 102 and portions thereof.

Figure 6:
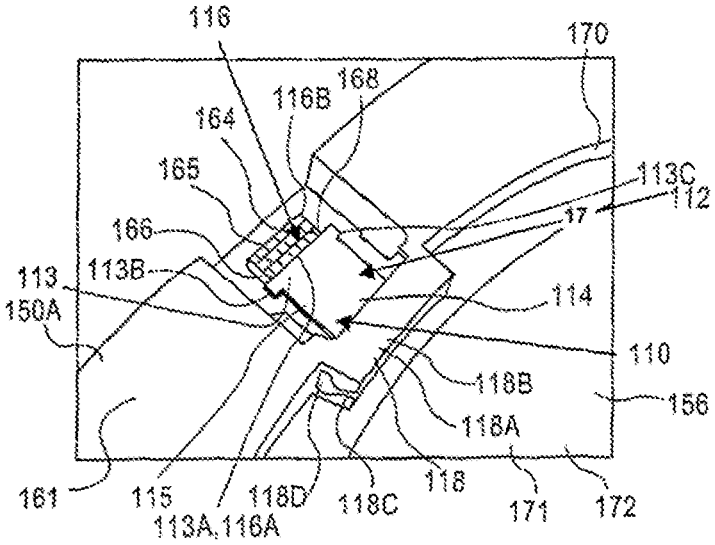
FIG. 6 illustrates a perspective view of a portion of a circular OD security device including a locking mechanism, in accordance with one embodiment.

Referring first to FIG. 6, this figure illustrates a perspective view of a portion of a circular OD security device 102 including a locking mechanism 110, in accordance with one embodiment. The locking mechanism 110 may include a magnetically actuable latch 112, a flexible element 116, and a latch mating element 118.

The magnetically actuable latch 112 may comprise a magnetic material, and may comprise one or more materials such as described with respect to the magnetically actuable latch 12 of FIG. 1. The magnetically actuable latch 112 may include a base portion 113, which may include a base portion end 113A and base portion side surfaces 113B and 113C; a latching portion 114, which may include a latching portion end 114A (positioned with the latch mating element 118 and therefore not shown in FIG. 6, but shown in FIG. 10); and a central portion 115.

The magnetically actuable latch 112 may be shaped like a "T". Thus, the base portion side surfaces 113B and 113C may be parallel and each may be at least substantially straight, and the width of the base portion 113, which may be the distance between base portion side surfaces 113B and 113C, may be wider than the other widths of the magnetically actuable latch 112. The base portion end 113A may be flat and may be substantially perpendicular to the base portion side surfaces 113B and 113C. The magnetically actuable latch 112 may be configured with a slender thickness. However, the magnetically actuable latch 112 may be otherwise configured in various embodiments, such as described herein with respect to the magnetically actuable latch 12 shown in FIG. 1

The flexible element 116 may comprise or be formed of a flexible material, and may include a material or materials such as described herein with respect to the flexible element 16 shown in FIG. 1. The flexible element 116, in one embodiment, may be configured with a substantially cuboidal shape such that its side 116A is wider than its side 116B, or may have another shape. In various other embodiments, the flexible element 116 may be configured as, and comprise one or more materials of, a coil or other spring or like member, such as described above with respect to the magnetically actuable latch 12 of FIG. 1. In addition, in one embodiment, the flexible element 116 may be combined or integrally formed with the magnetically actuable latch 112. In one embodiment, the flexible element 116 may be shaped as a cantilever arm, such as for example, a leaf spring.

The latch mating element 118 may be integral with the housing 130 or a portion thereof as described below, or may be a separate piece or pieces.

Figure 7:
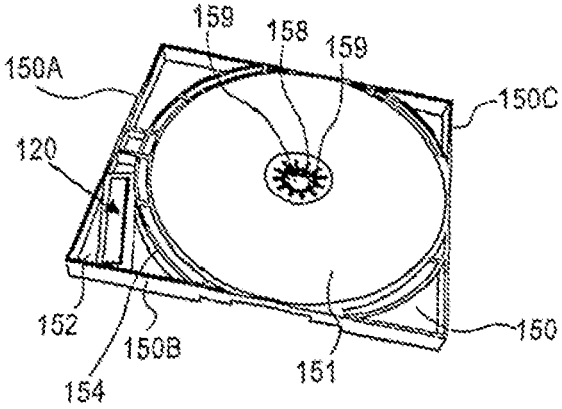
FIG. 7 illustrates a perspective view of a bottom housing and security tag of a circular OD security device, in accordance with one embodiment.
Figure 12A:
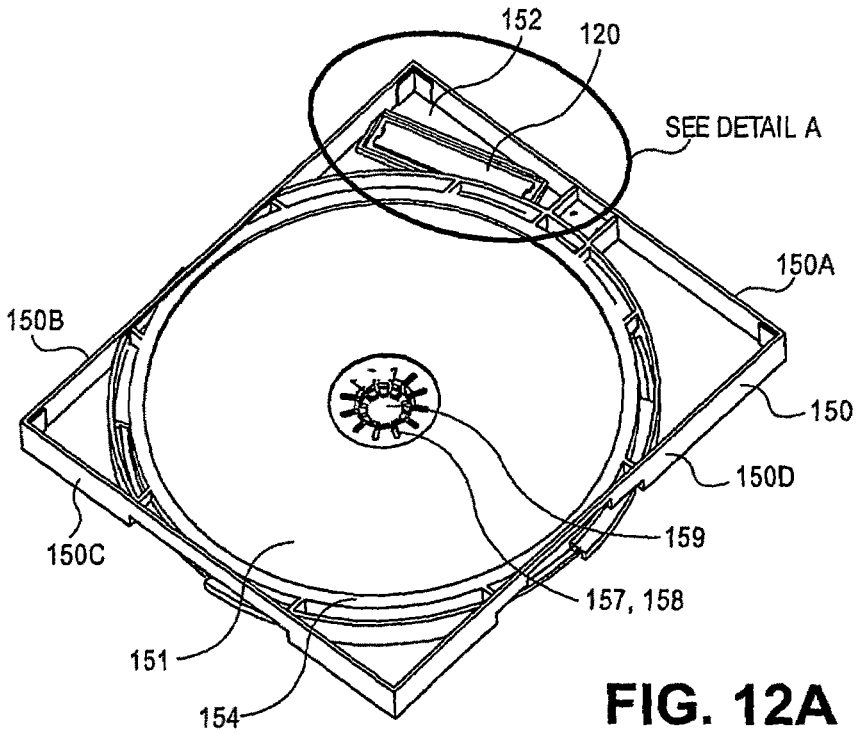
FIG. 12A illustrates a perspective view of a security tag and bottom housing of a circular OD security device, in accordance with one embodiment.
Figure 12B:
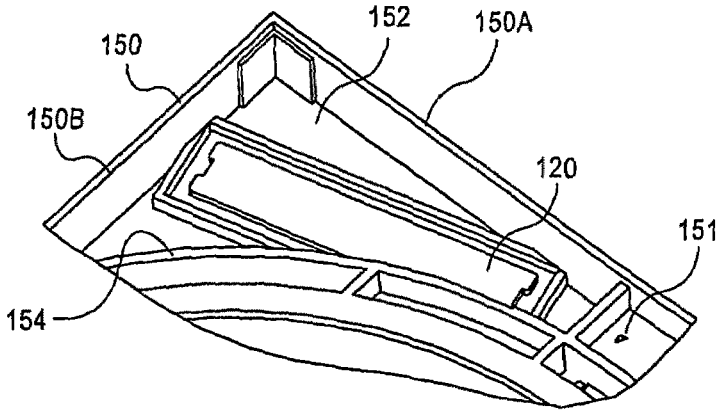
FIG. 12B illustrates an enlarged view of a portion A of FIG. 12A.

FIGS. 7 and 12A illustrate perspective views of a bottom housing 150, as described below, and a security tag 120 of a circular OD security device 102, in accordance with one embodiment. FIG. 12B illustrates an enlarged view of a portion A of the bottom housing 150 of FIG. 12A. Referring to FIGS. 7, 12A, and 12B, the security tag 120 may be an elongated EAS tag or label. In various other embodiments, the security tag 120 may be another type and/or shape of security tag or label, such as described herein with respect to the security tag 20 shown in FIG. 1. The security tag 120 may be affixed to the bottom housing 150, such as by epoxy, adhesive, or other means. In various other embodiments, the security tag 120 may be located on, disposed within, or secured to various other surfaces of the circular OD or other article.

The housing 130 of the circular OD security device 102, shown at least in part in each of the embodiments of FIGS. 2-13, may include the bottom housing 150, a locking mechanism cover 180, security tag cover 190, bottom cover 200, and top cover 205. In one embodiment, one or more of these components of the housing 130 may be separate components. In various other embodiments, one or more combinations of components may each comprise one piece or multiple pieces inseparably attached into one piece. Each of these components of the housing 130 may, in various embodiments, be made of plastic, another material, or a combination of materials. These components may, in various embodiments, comprise the same or different material or combination of materials.

Figure 5:
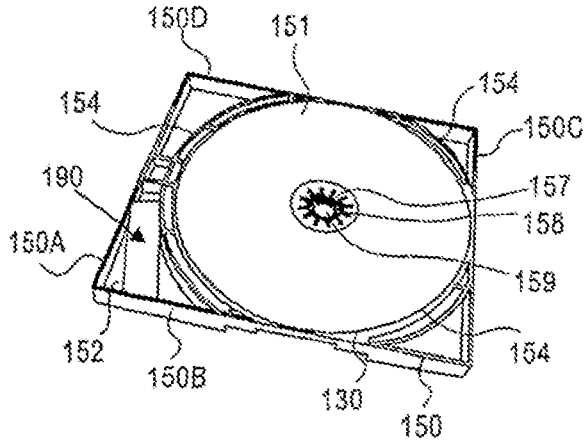
FIG. 5 illustrates a perspective view of a security tag cover and bottom housing of a circular OD security device, in accordance with one embodiment.
Figure 13A:
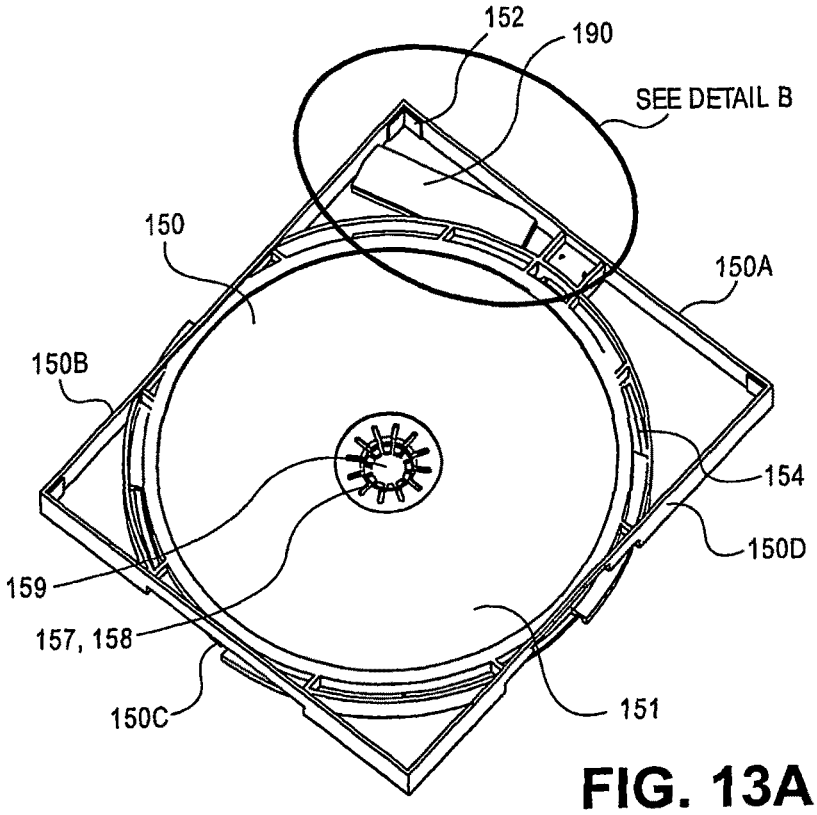
FIG. 13A illustrates a perspective view of a security tag cover and bottom housing of a circular OD security device, in accordance with one embodiment.
Figure 13B:
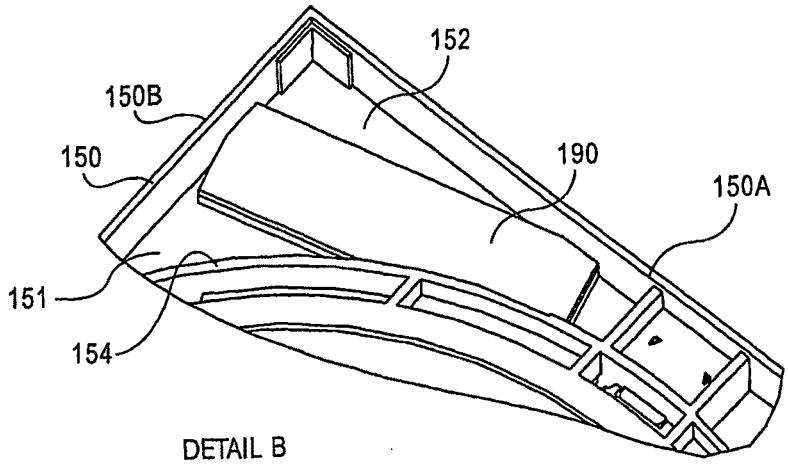
FIG. 13B illustrates an enlarged view of a portion B of FIG. 13A.

FIGS. 5 and 13A illustrate perspective views of a security tag cover 190, which is described below, and a bottom housing 150, in accordance with one embodiment. FIG. 13B illustrates an enlarged portion B of the bottom housing 150 of FIG. 13. Referring to the embodiments of FIGS. 5, and 13A-13B, the bottom housing 150 may have a rectangular outer shape delineated by bottom housing perimeter walls 150A through 150D. The bottom housing 150 may include a base 151 that includes a security tag receptacle 152, arcuate internal wall 154, and the base of a circular OD receptacle 156 comprising the base of a circular OD mating element 157 and a void 159. The security tag receptacle 152 may be delineated by the bottom housing perimeter walls 150A and 150D and the arcuate internal wall 154, and may be sized to receive an elongated security tag 120 and possibly also a security tag cover 190, such as described herein. In various embodiments, the housing perimeter walls 150A and 150C and/or 150B and 150D may be elongated to increase the area of the security tag receptacle 152, such that larger and/or differently sized security tags 120 may fit within the security tag receptacle 152.

The circular OD receptacle 156 may be integral with one or more of the bottom housing perimeter walls 150B through 150D and possibly the arcuate internal walls 154, or may be otherwise secured with the bottom housing 150.

Referring again to FIG. 6, this figure also illustrates a perspective view of an embodiment of part of the upper portion 161 of the bottom housing 150. The upper portion 161 may be configured such that the magnetically actuable latch 112 and flexible element 116 may be adjacently disposed therein. Thus, the base portion end 113A of the magnetically actuable latch 112 may be positioned near or in abutment with the flexible element 116. With such a configuration of the upper portion 161, the movement of the magnetically actuable latch 112 and flexible element 116 may be restricted in one or more directions.

For example, the upper portion 161 of the bottom housing 150 may include a channel end wall 165, channel walls 166 and 168, and a channel 164 that is delineated by the channel walls 166 and 168 and may be bounded by the channel end wall 165. The channel walls 166 and 168 may include portions substantially parallel to each other, and may be positioned close to or in contact with the magnetically actuable latch 112 at the base portion side surfaces 113B and 112C and at the sides of the central and latching portions 115 and 114, respectively, thereby restricting the movement of the magnetically actuable latch 112 to movement along the channel 164, which may be movement in a substantially linear direction. In various other embodiments, the magnetically actuable latch 112 may move in a rotational, combination rotational/linear direction, or any other direction or directions. In these various other embodiments, one or more of the channel 164, flexible element 116, and latch mating element 118 may be contoured, shaped, or otherwise configured to guide the magnetically actuable latch 112 in the direction or directions.

The flexible element 116 may be positioned adjacent the channel end wall 165 such that where the magnetically actuable latch 112 is forced away from the locking position and against the flexible element 116, the flexible element 116 may compress by the force of the magnetically actuable latch 112 and the resistant force of the channel end wall 165. The flexible element 116 may provide a resistant force to such compression, against such movement of the magnetically actuable latch 112.

As described above, in each of various embodiments the magnetically actuable latch 112 may be configured with another shape, in which case the channel 164, and thus the channel walls 166 and 168, may be configured to accommodate such a magnetically actuable latch 112 and possibly restrict the movement of the magnetically actuable latch 112 in one or more directions. In each of these embodiments, the flexible element 116 may be configured to fit within the channel 164.

Figure 10:
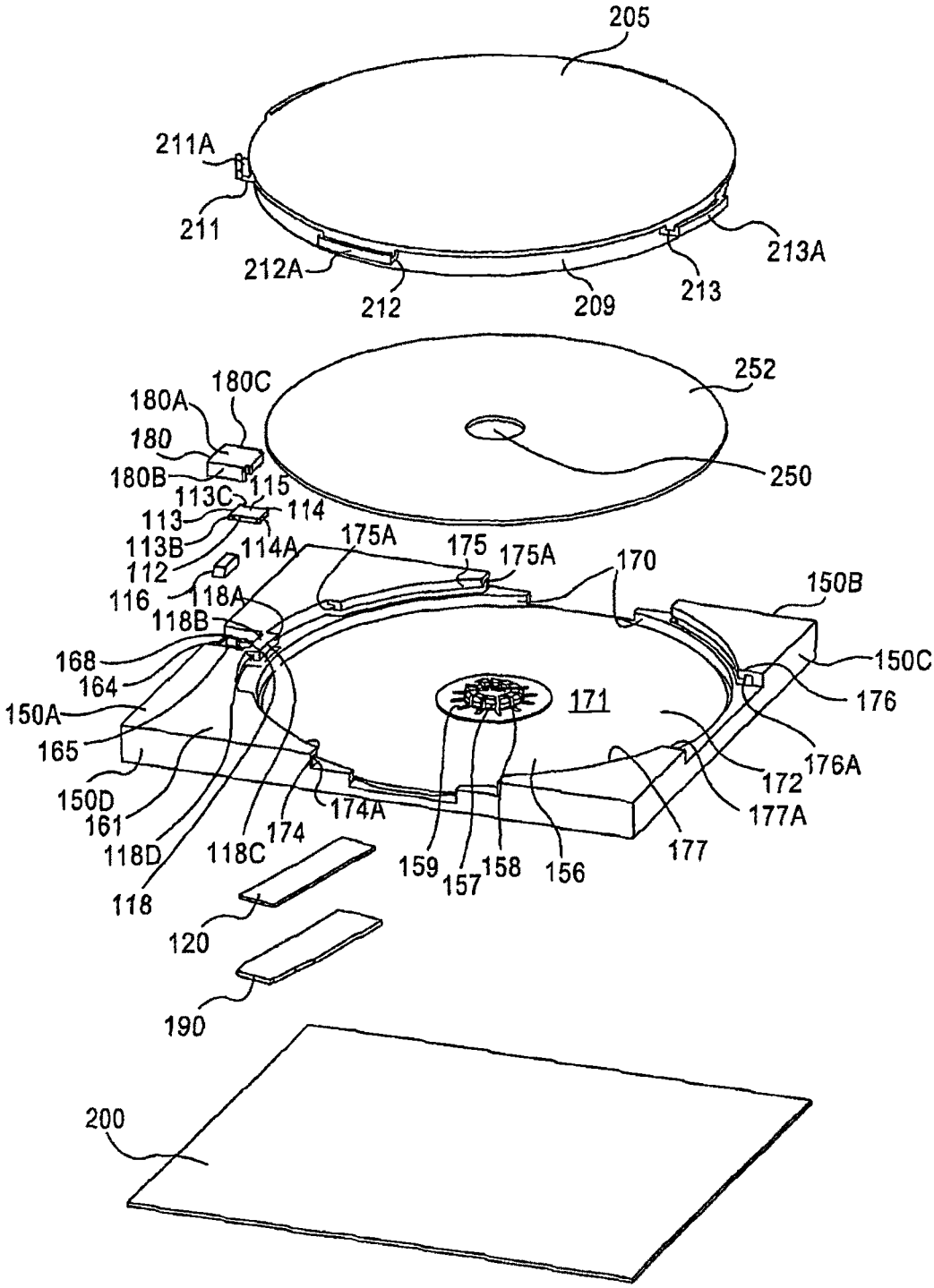
FIG. 10 illustrates an exploded view of a circular OD security device, in accordance with one embodiment.

FIG. 10 illustrates an exploded view of a circular OD security device 102, in accordance with one embodiment. Referring to FIG. 10 and again to FIG. 5, the upper portion 161 of the bottom housing 150 may include the upper portion of the circular OD receptacle 156. The upper portion of the circular OD receptacle 156 may comprise the OD mating element 157, a basin wall 170, a basin floor 171, and a basin 172 delineated by the basin wall 170 and basin floor 171. The OD mating element 157 may include one or more cantilevered prongs 158 that may be integral with, and define a void 159 of the bottom housing 150. The cantilevered prongs 158 may be positioned in a circular configuration as shown, and may be made of a material, such as a plastic, such that the cantilevered prongs 158 are resilient when bent inward, or toward the hole. The circular configuration may define an outer boundary having a radius that is the same or greater than that of the central hole of a circular OD, such as the central hole 250 of the circular OD 252. Thus, a circular OD may be disposed around, and secured by, the cantilevered prongs 158 and thus the OD mating element 157 by interference fit. When the circular OD is removed, the cantilevered prongs 158 may spring back to their unbent positions. In one embodiment, the circular configuration of the cantilevered prongs 158 may define an outer boundary having a radius that is less than that of the central hole of a circular OD.

In various other embodiments, the OD mating element 157 may comprise another structure, such as a solid, hollow, pronged, or other structure that may that mate with the central hole of a circular OD by interference fit, snap-fit, or other means. In another embodiment, the circular OD receptacle 156 does not include an OD mating element 157.

The basin wall 170 may be configured, such as circularly or otherwise configured, to delineate a basin 172 large enough such that a circular OD may fit within the basin 172 with or without contacting the basin wall 170.

The upper portion of the bottom housing 150 may also include groove walls 174-177 and arcuate grooves 174A-177A (177A is obscured and therefore cannot be seen in the FIG. 10) delineated by the groove walls 174-177, respectively. For example, the groove wall 174 may be included and may define an arcuate groove 174A. The interior of the groove wall 174, adjacent the arcuate groove 174A, may be shaped like a "J" or "U". Groove walls 175-177 may be included and comprise arcuate grooves 175A-177A. The arcuate grooves 174A-177A may be similarly shaped or substantially identical in shape. The groove walls 174-177 may each be positioned above or be integral with the basin wall 170, and may be spaced such that an optical OD may be moved past them to be disposed in, or removed from, the basin 172.

Referring again to FIG. 6 along with FIG. 10, the upper portion of the bottom housing 150 may also include the latch mating element 118. The latch mating element 118 may be integral with the bottom housing 150 and may extend between the channel walls 166 and 168 and may be cantilevered therefrom. The latch mating element 118 may comprise a latch mating element wall 118A having a hood 118B, end wall 118C, and a recess 118D defined by the latch mating element wall 118A. The latch mating element wall 118A may be configured such that the recess 118D is shaped like one or more of the arcuate grooves 174A-177A described above.

The latching portion 114 and possibly more of the magnetically actuable latch 112 may extend under the hood 118B and thus into the recess 118D when in the locking position. In one embodiment, the latching portion 114 and possibly more of the magnetically actuable latch 112 may extend across the recess 118D and to the end wall 118C.

The housing 130 may also include the locking mechanism cover 180 illustrated in the embodiment of FIGS. 2-4 and 10. The locking mechanism cover 180 may comprise a structure configured to be positioned over the flexible element 116 and at least a portion, such as an exposed portion, of the magnetically actuable latch 112. For example, as shown in FIG. 10, the locking mechanism cover 180 may include a hood 180A and sidewalls 180B and 180C that may cooperate with the channel 164 and/or channel walls 166 and 168 to enclose an exposed portion of the magnetically actuable latch 112 disposed in the channel 164. The locking mechanism cover 180 may be secured with the bottom housing 150, such as by welding, fusing, gluing, snap-fit (such as where the channel walls 166 and 168 and locking mechanism cover 180 are configured with mating protrusions and voids, for example), interference fit, and/or by other securing means. As secured, the locking mechanism cover 180 may prevent or increase the difficulty of removing the magnetically actuable latch 112 from the bottom housing 150.

Referring again to the embodiments of FIGS. 5 and 13A-13B, the housing 130 may also include a security tag cover 190. The security tag cover 190 may be configured to fit over the security tag 120, and may be secured within the security tag receptacle 152 and/or to the security tag 120, such as via fusing, welding, gluing, taping, mechanical fit, or by other means.

Figure 8:
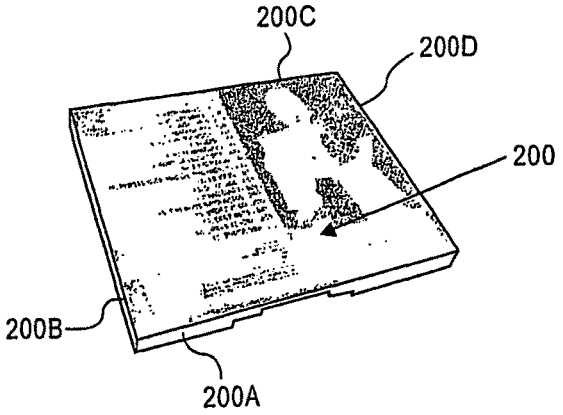
FIG. 8 illustrates a perspective view of a bottom cover of a circular OD security device, in accordance with one embodiment.

Referring to FIG. 8, this figure illustrates a perspective view of a bottom cover 200 of a circular OD security device 102, in accordance with one embodiment. The bottom cover 200 may be configured to be secured to the bottom housing 150. For example, the bottom cover 200 may have a rectangular shape delineated by bottom cover perimeter walls 200A through 200D and sized such that the bottom cover perimeter walls 200A and 200D may be secured around the bottom housing perimeter walls 150A through 150D of the bottom housing 150. Such securing may be by snap-fit, glue, tape, and/or by another means. In an embodiment where the bottom housing 150 is differently shaped, the bottom cover 200 may be configured with a complementary shape such that it may be secured to the bottom housing 150.

When the bottom cover 200 is secured to the bottom housing 150, the security tag 120 may be enclosed and thus secured therein so it may not be reached and removed.

Figure 9:
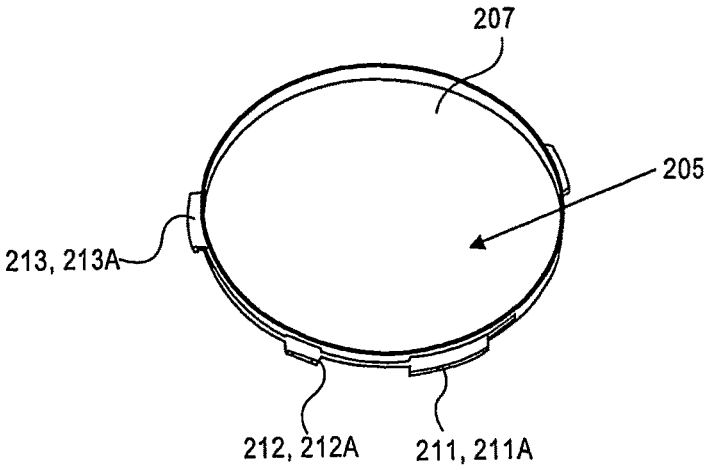
FIG. 9 illustrates a perspective view of a top cover of a circular OD security device, in accordance with one embodiment.

FIG. 9 illustrates a perspective view of a top cover 205 of a circular OD security device 102, in accordance with one embodiment. Referring to FIG. 9 along with the embodiments of FIGS. 2-4 and 10, the housing 130 may also include a top cover 205. The top cover 205 may be configured with a top cover base 207 that may be solid and may be bounded by a top cover wall 209. The top cover base 207 and top cover wall 209 may be circular and sized such that the inner radius of the top cover wall 209 is greater than the outer radius of a circular OD. In such a case, where a circular OD is disposed within the basin 172 of the bottom housing 150, as described above, the top cover base 207 and top cover wall 209 may fit over and around, respectively, the circular OD, thus enclosing the circular OD within the housing 130.

The top cover 205 may further include guide walls 211-213. The guide walls 211-213 may extend from the top cover wall 209 and may be shaped to cooperate with the groove walls 174-177 and latch mating element 118, including the latch mating element wall 118A. For example, in one embodiment, the guide walls 211-213 may extend from the top cover wall 209 in an "L" shape having arcuate lips 211A-213A, respectively, that are substantially parallel to the top cover wall 209. Thus, when the top cover 205 is fitted over and around a circular OD to enclose the circular OD within the housing 130, as described above, the arcuate lips 211A-213A of the guide walls 211-213, respectively, may slide within the arcuate grooves 174A-177A and recess 118D of the bottom housing 150 when the top cover 205 is rotated.

The top cover 205 may be positioned over a circular OD and onto the bottom housing 150 such that the latch mating element 118 is positioned between the guide walls 212 and 213. In this position, the arcuate lips 212A and 213A of the guide walls 212 and 213, respectively, may be positioned at least partly within the arcuate grooves 174A and 175A of the bottom housing 150. Since the magnetically actuable latch 112 may be biased by the flexible element 116 into the locking position within the recess 118D of the latch mating element 118, the magnetically actuable latch may block the arcuate lips 212A and 213A from being slid through recess 118D. Such a configuration may allow only limited rotation of the top cover 205 such that within this limited rotation, at least one of the arcuate lips 211A-213A may be positioned at least partly within an arcuate groove 174A-177A, thus securing the top cover 205 to the bottom housing 150. In another embodiment, the arcuate lips 211A-213A may be configured such that within that limited rotation, at least two of the arcuate lips 211A-213A are each positioned at least partly within an arcuate groove 174A-177A, further securing the top cover 205 to the bottom housing 150.

In various other embodiments, the mechanism for securing the top cover 205 to the bottom housing 150 may be modified, for example in one or more of the following ways: the bottom housing 150 may include variously sized and/or less than all of the groove walls 174-177 and thus the arcuate grooves 174A-177A, or may include additional groove walls and arcuate grooves; the bottom housing top cover 205 may include variously sized and/or less than all three guide walls 211-213, and thus the arcuate lips 211A-213A; and/or the shapes of the groove walls, grooves, guide walls, and lips of the bottom housing 150 and top cover 205 may be modified. Thus, for example, the number and size of the groove walls, arcuate grooves, guide walls, and arcuate lips may be configured in the bottom housing 150 and top cover 205 such that the top cover 205 may be secured to the bottom housing 150 of the circular OD security device 102 when the magnetically actuable latch 112 is in the locking position, as described above.

In another embodiment, a circular optical OD security device system includes the circular optical OD security device 102 and a detacher, such as the detacher 40. Where the detacher 40 is placed near the magnetically actuable latch 112 of the security device 102 such that the flexible element 116 is positioned between the detacher 40 and magnetically actuable latch 112, the detacher 40 may magnetically force the magnetically actuable latch 112 out of the locking position and against the flexible element 116. If the magnetic force is greater than the compressive force of the flexible element 116 and any other forces resisting such movement of the magnetically actuable latch 112, the magnetically actuable latch 112 may move out of the locking position. In such case, the top cover 205 will no longer be blocked from full rotation, and the top cover 205 may be freely rotated. Thus, the top cover 205 may be rotated until no portion of any of its arcuate lips 211A-213A is positioned within an arcuate groove 174A-177A of the bottom housing 150, in which case the top cover 205 may be removed, exposing any circular OD that may be disposed within the basin 172 of the bottom housing 150. In other embodiments, the top cover 205 may be rotatably attached to the bottom housing 150 in a hinged or other suitable arrangement. In other embodiments, the top cover 205 may be otherwise securable or secured to the bottom housing 150, whether rotatably secured or attached. Because no part of the circular OD security device 102 in this embodiment may be broken during the process of unlocking it, the circular OD security device 102 may be reusable.

In one embodiment, the circular OD security device 102 may, or may be configured to, enclose or contain a CD, and may be called a CD security device 102. In this embodiment, the CD security device 102 may, or may be configured to, enclose or contain any other type of circular OD as well. The CD security device 102 may be capable of holding an EAS tag, magnetic mechanism, and any type of CD. This security device may, in one embodiment, carry an EAS component and may be utilized to provide resistance to or prevent the unauthorized from taking and then leaving a store with the CD security device, and any type of CD that may be enclosed or otherwise secured thereto. In one embodiment, this security device may include a bottom housing, EAS label, EAS label cover, bottom cover, latch mechanism cover, magnetically actuable latch mechanism, and top cover. In one embodiment, the circular OD security device 102 may comprise this security device such that the locking mechanism 110 may include the magnetically actuable latch mechanism, the security tag 120 may include the EAS label or tag, and the housing 130 may include portions comprising the bottom housing, EAS label cover, bottom cover, latch mechanism cover, and top cover, which portions may correspond to the bottom housing 150, security tag cover 190, bottom cover 200, locking mechanism cover 180, and top cover 205, respectively.

FIGS. 14-19 illustrate perspective views of examples of housing, locking mechanisms, and other element embodiments that may be included in a security device, such as the security device 2, for example.

Figure 14:
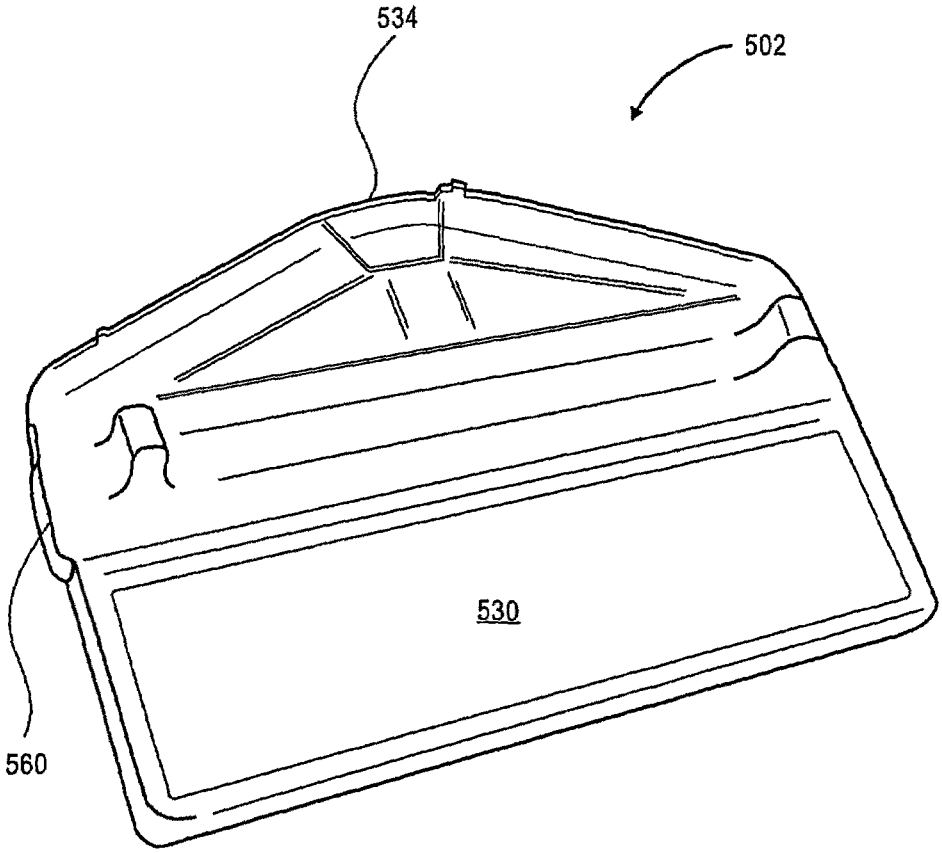
FIG. 14 illustrates a perspective view of a security device having a tunnel, in accordance with one embodiment.
Figure 15:
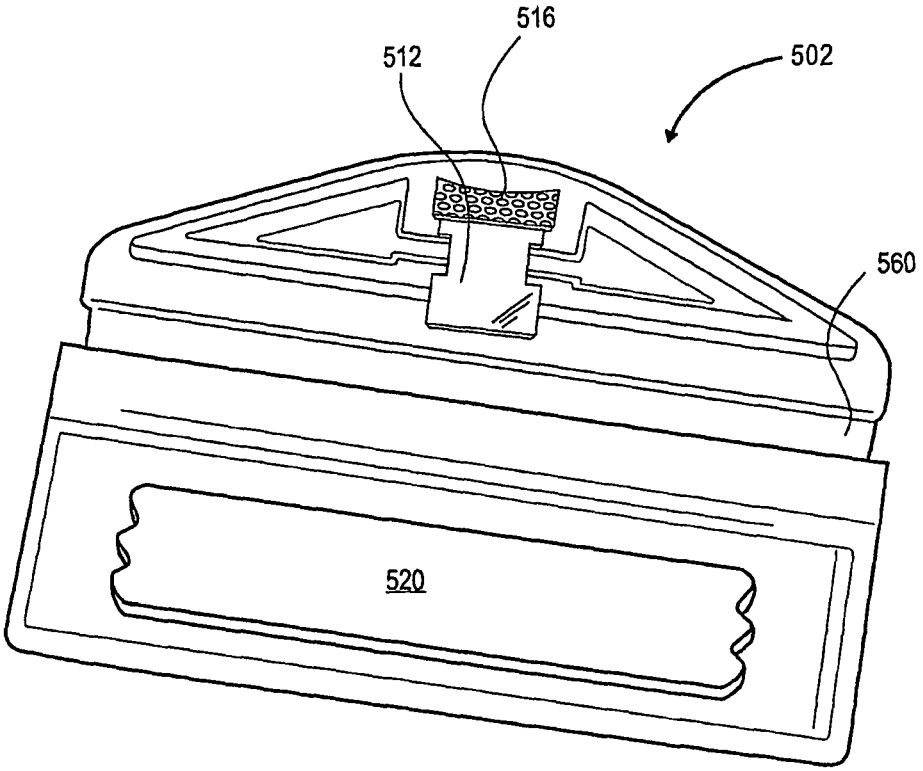
FIG. 15 illustrates a perspective view of a portion of security device having a tunnel, in accordance with one embodiment.

FIGS. 14-15 illustrate perspective views of a security device 502 embodiment and portions thereof that may be employed to secure certain articles having elongated elements, such as eyeglasses. The security device 502 may include a housing 530 having a partially rectangular shape with an outwardly bowed side 534. The security device 502 may secure a leg of the eyeglasses within the tunnel 560. The security device 502 may include an at least partially "T" shaped magnetically actuable latch 512, an at least partially cuboidal flexible element 516, and a security tag 520.

Figure 16:
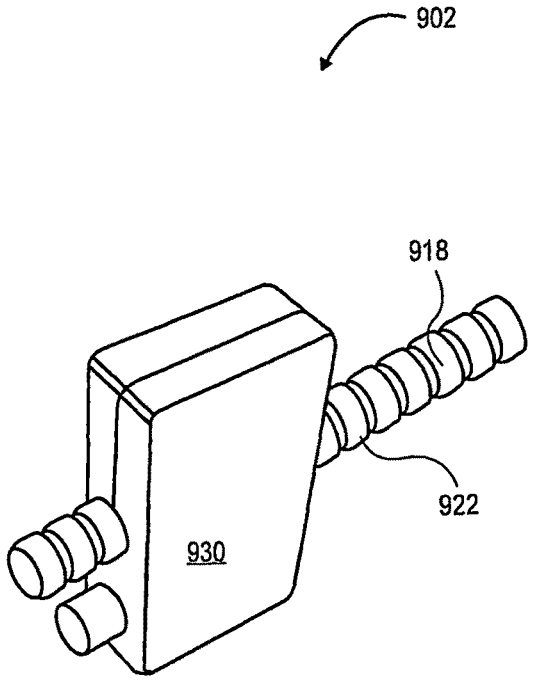
FIG. 16 illustrates a perspective view of a security device having a cable, in accordance with one embodiment.
Figure 17:
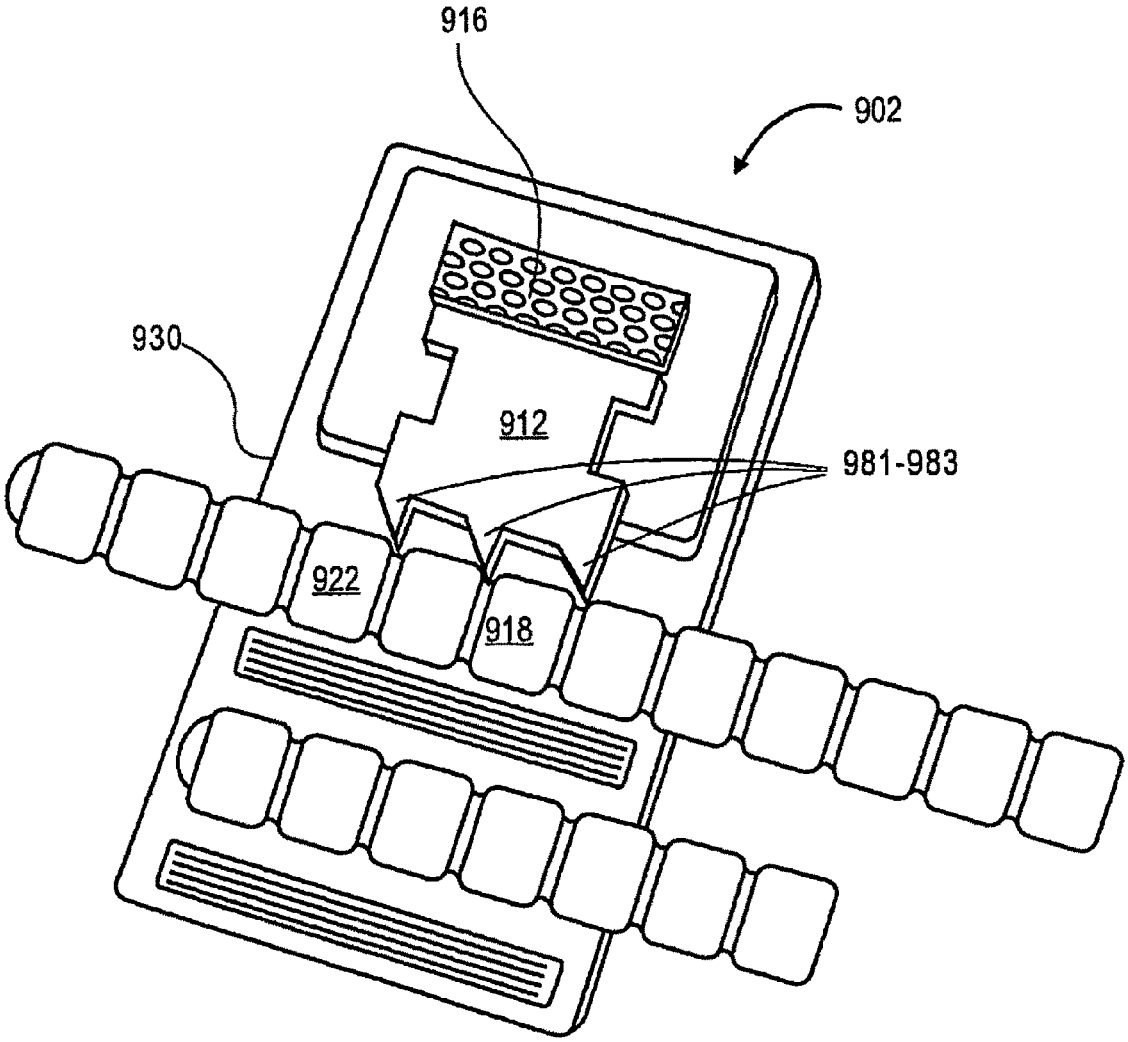
FIG. 17 illustrates a perspective view of a portion of a security device having a cable, in accordance with one embodiment.

FIGS. 16-17 illustrate perspective views of a cabled security device 902 embodiment and portions thereof that may be employed to secure an article with a cable 922. The security device 902 may have a housing 930 shaped like a short "I" or lowercase "l" and may be configured to receive at least a portion of a cable 922. The security device 902 may secure various articles, such as clothing, purses, and other articles. The security device 902 may include a magnetically actuable latch 912 having teeth 981-983 or other protrusions. The cable 922 may include the latch mating element 918.

Figure 18:
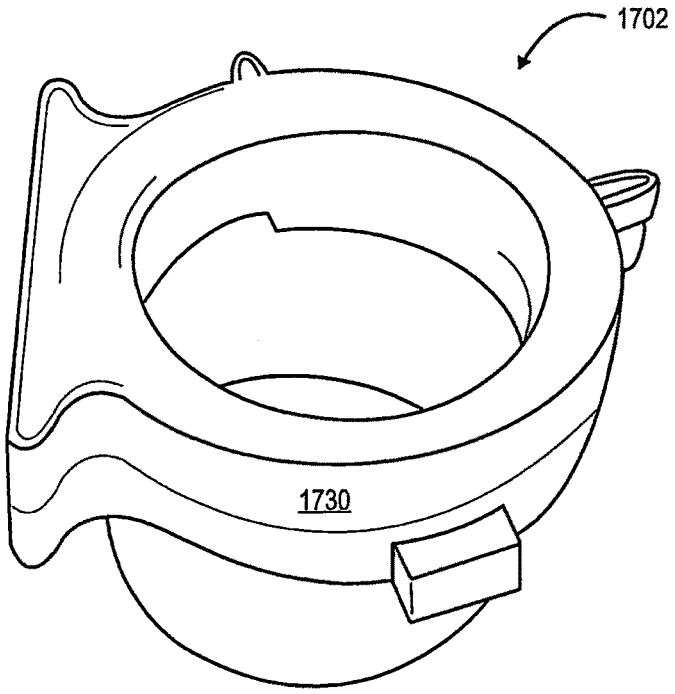
FIG. 18 illustrates a perspective view of a bottle security device, in accordance with one embodiment.
Figure 19:
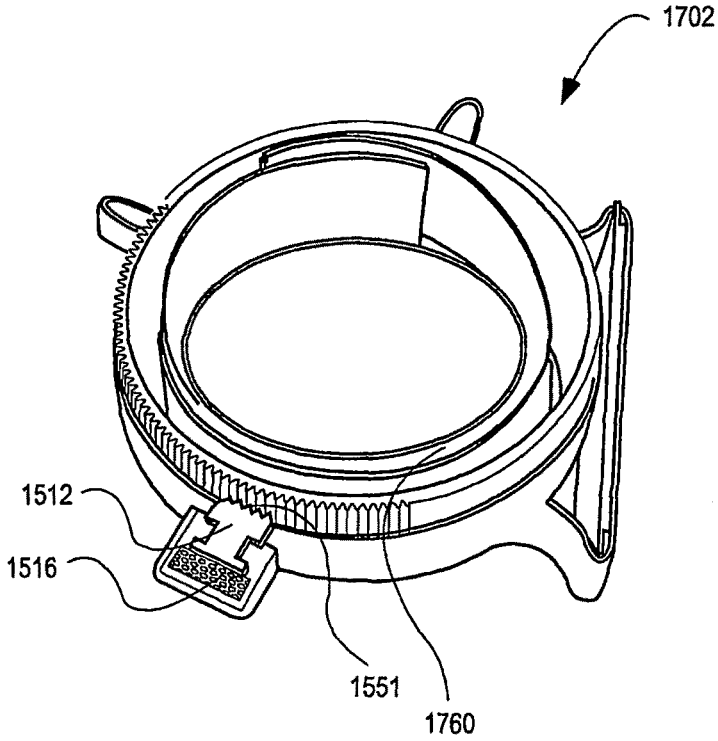
FIG. 19 illustrates a perspective view of a portion of a security device for a bottle, in accordance with one embodiment.

FIGS. 18-19 illustrate perspective views of a bottle security device 1702 embodiment and portions thereof. The bottle security device 1702 may have a housing 1730 shaped to fit around the mouth and at least part of the neck of a bottle, such as a wine or liquor bottle. The security device 1702 may include a magnetically actuable latch 1512 having one or more protrusions 1551, which may be teeth, for example. The flexible element 1516 may have an at least partially rectangular outer face. The security device 1702 may include a security belt 1760 that may constrict around at least part of the neck of a bottle to secure the security device thereto.

Figure 23:
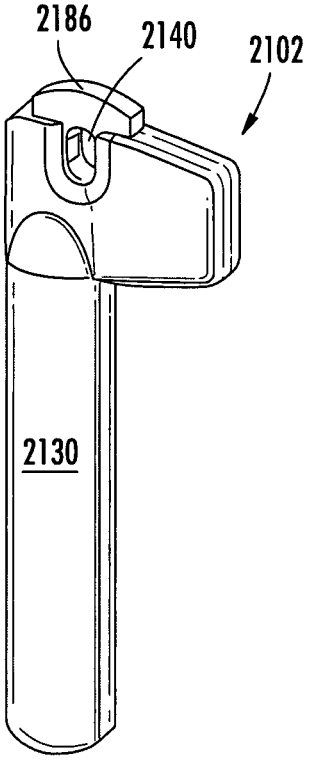
FIG. 23 illustrates a perspective view of a hook tag security device, in accordance with one embodiment.
Figure 24:
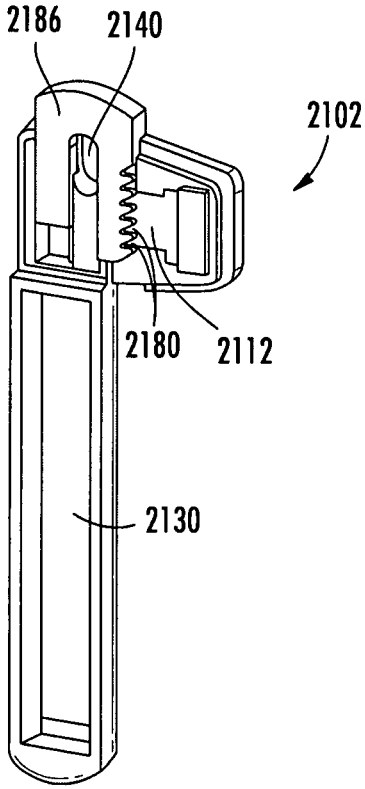
FIG. 24 illustrates a perspective view of a portion of hook tag security device, in accordance with one embodiment.

FIGS. 23-24 illustrate perspective views of a hook tag security device 2102 embodiment and portions thereof. The hook tag security device 2102 may have a housing 2130 that is at least partially L shaped, and may include a hooking element 2186, which may cooperate with the housing 2130 to secure various articles in the article receiving recess portion 2140 various embodiments, such as a pair of glasses, a shoe, a piece of jewelry, a ring, a fishing reel and/or rod, or a whole or portion of another item. The hook tag security device 2102 may include a magnetically actuable latch 2112, which may include one or more protrusions 2180, such as teeth, for example. The hooking element 2186 may include the latch mating element 2118, which may engage the magnetically actuable latch 2112 in the locking position to secure an article between the hooking element 2186 and the housing 2130.

While certain features of the embodiments have been illustrated as described herein, many modifications, substitutions, changes and equivalents will now occur to those skilled in the art. It is, therefore, to be understood that the appended claims are intended to cover all such modifications and changes as fall within the scope of the embodiments.

The invention claimed is:

1. A detacher for unlocking a security device having a detectable security tag therein, the security device having a magnetically-actuable locking mechanism, the magnetic-actuable locking mechanism including a magnetic latch which can be moved from a locked position to an unlocked position by application of an external magnetic force, a latch-mating element for engaging with the magnetic latch in the locked position, and a flexible element for providing a resistive force to bias the magnetic latch into the locked position, comprising:

a magnet configured to exert a magnetic force on the security device, the magnetic force exerted by the magnet having a strength sufficient to overcome the resistive force of the flexible element to allow the magnetic latch to move from the locked position to an unlocked position;

a motor coupled with the magnet;

a housing comprising a nest, the magnet and motor disposed in the housing, the motor arranged and configured to cause movement of the magnet with respect to the nest; and a security tag interrogator disposed in the housing, the security tag interrogator including a security tag antenna and a security tag reader.

2. The detacher of claim 1, wherein the security tag antenna is an RFID tag antenna.

3. The detacher of claim 1, wherein the security tag interrogator includes an EAS tag interrogator.

4. The detacher of claim 1, wherein the security tag interrogator includes an RFID tag reader.

5. The detacher of claim 3, wherein the EAS tag interrogator is an acousto-magnetic tag interrogator.

6. The detacher of claim 1, wherein the security tag interrogator is for a combination EAS and RFID tag.

7. The detacher of claim 1, wherein the magnet is operable to engage the magnetically actuable locking mechanism in the security device by magnetically forcing a magnetically actuable latch in the security device away from a locking position.

8. The detacher of claim 1, further comprising an integral article identifier.

9. The detacher of claim 8, wherein the article identifier is a bar code scanner.

10. The detacher of claim 1, further comprising a proximity sensor disposed adjacent the nest.

11. A detacher for unlocking a security device having a detectable security tag therein, the security device having a magnetically-actuable locking mechanism, comprising:

a magnet to engage the magnetically-actuable locking mechanism in the security device;

a motor coupled with the magnet;

a housing comprising a nest, the magnet and motor disposed in the housing, the motor arranged and configured to cause movement of the magnet with respect to the nest; and a security tag interrogator disposed in the housing, the security tag interrogator including a security tag antenna and a security tag reader; and a shield positioned between the magnet and at least one of the security tag reader and the security tag antenna, the shield configured and positioned to control at least one of the direction and force of the magnetic field emitted by the magnet.

12. The detacher of claim 1, wherein the magnet is selectively movable between two or more discrete positions with respect to the nest thereby selectively varying the strength of the magnetic field applied to the nest.

13. The detacher of claim 12, wherein each of the two or more discrete positions are respectively associated with two or more categories of security devices.

14. The detacher of claim 12, wherein each of the two or more discrete positions are associated with a different category of article to be secured, the magnet in each of the two or more positions operable to engage with the magnetically-actuable locking mechanism of a security device attached to the associated article.

15. The detacher of claim 12, wherein one of the two or more discrete positions of the magnet is selected based on data read from the security tag.

16. The detacher of claim 11, wherein the shield obstructs of the magnetic field.

17. The detacher of claim 11, wherein the shield directs the magnetic field towards the nest.

* * * * *